US006848284B2

(12) United States Patent
Chen

(10) Patent No.: US 6,848,284 B2
(45) Date of Patent: Feb. 1, 2005

(54) LOCK ASSEMBLY

(75) Inventor: Waterson Chen, 8F, No. 428, Wu-Chan S. Rd., Taichung City (TW)

(73) Assignee: Waterson Chen, Taichung (TW)

( * ) Notice: Subject to any disclaimer, the term of this patent is extended or adjusted under 35 U.S.C. 154(b) by 82 days.

(21) Appl. No.: 10/310,308

(22) Filed: Dec. 5, 2002

(65) Prior Publication Data

US 2004/0107744 A1 Jun. 10, 2004

(51) Int. Cl.[7] ..... E05B 67/38

(52) U.S. Cl. ..... 70/56; 70/203; 70/417; 292/286

(58) Field of Search ..... 70/52–56, 203, 70/200, 205, DIG. 56, 417, 2, 3–12; 292/285, 231–234, 286

(56) References Cited

U.S. PATENT DOCUMENTS 3,734,552 A * 5/1973 Haxton ..... 292/67
3,996,774 A * 12/1976 Best ..... 70/32
4,322,102 A * 3/1982 Lindblom ..... 292/281
4,324,426 A * 4/1982 Michelson ..... 292/281
4,745,783 A * 5/1988 Poe ..... 70/2
4,949,560 A * 8/1990 Anderson ..... 70/54
5,174,135 A * 12/1992 Loughlin ..... 70/2
5,477,710 A * 12/1995 Stefanutti ..... 70/56
6,036,240 A * 3/2000 Hamilton et al. ..... 292/202
6,050,114 A * 4/2000 Park ..... 70/2
6,179,350 B1 * 1/2001 Ely et al. ..... 292/113
6,609,739 B1 * 8/2003 Avganim ..... 292/295

* cited by examiner

*Primary Examiner*—John B. Walsh
(74) *Attorney, Agent, or Firm*—Webb Ziesenheim Logsdon Orkin & Hanson, P.C.

(57) ABSTRACT

A lock assembly includes two mounting seats for mounting respectively on two objects. Each mounting seat has a shackle engaging lobe. A slide seat is slidable between the mounting seats for selectively engaging the mounting seats. A cover member is pivoted to the slide seat for pivoting between closed and open positions, and has another shackle engaging lobe. The lobe on the cover member is disposed between the lobes of the mounting seats to permit extension of a padlock shackle through the three lobes when the cover member is in the closed position while the slide seat engages the two mounting seats. The cover member is turned away from the lobes of the mounting seats to permit sliding movement of the slide seat between the mounting seats when the cover member is moved to the open position after removal of the shackle from the lobes.

10 Claims, 34 Drawing Sheets

LOCK ASSEMBLY

BACKGROUND OF THE INVENTION

1. Field of the Invention

The present invention relates to a lock assembly which includes a shackle that can be substantially shielded to achieve an enhanced anti-theft effect.

2. Description of the Related Art

Lock devices, such as padlocks, are in common use for locking together two objects. Typically, the objects are each provided with a lobe that has a hole formed therethrough. The shackle of a padlock extends through the holes in the lobes for locking together the objects, such as two door panels. To prevent the shackle from being sawn by a thief, the lobe on one of the door panels is provided with a bent guard plate extending integrally therefrom for protecting the shackle.

However, it is found that the bent guard plate often interferes with movement of one of the door panels relative to the other one of the door panels after the padlock is unlocked and is removed from the lobes, and is thus unsatisfactory. It is further found that the shackle is only partly shielded by the guard plate when the padlock is locked. The shackle is still accessible, and can be damaged, such as with the use of a hydraulic cutter.

SUMMARY OF THE INVENTION

Therefore, the main object of the present invention is to provide a lock assembly which includes a shackle or shackle members that can be substantially shielded when the lock assembly is in a locking state, and which eliminates the need for forming bent guard plates on lobes of adjacent objects that are to be locked together so as to avoid interference to relative movement of the adjacent objects.

According to a first aspect of the present invention, a lock assembly includes first and second mounting seats, a padlock, a slide seat, and a cover member. The first mounting seat is adapted to be mounted on a first object, and has a rear side wall adapted to face the first object, and a front side wall provided with a first lobe that is formed with a first shackle hole therethrough. The first mounting seat is further formed with a first slide channel. The second mounting seat is adapted to be mounted on a second object, and has a rear side wall adapted to face the second object, and a front side wall provided with a second lobe which is formed with a second shackle hole that is axially aligned with the first shackle hole. The second mounting seat is formed with a second slide channel which is aligned and communicated with the first slide channel. The padlock includes a lock body and a U-shaped shackle mounted on the lock body. The slide seat has a sliding rod which is slidable along the first and second slide channels between an engaging position, in which the sliding rod extends into the first and second slide channels for engaging the first and second mounting seats, and a disengaging position, in which the sliding rod is disposed in the first slide channel and is removed from the second slide channel for disengaging from the second mounting seat so as to permit movement of one of the first and second mounting seats with the corresponding object relative to the other one of the first and second mounting seats. The cover member is mounted pivotally on the slide seat. The cover member confines an accommodating space, and is formed with a third lobe that is disposed in the accommodating space. The third lobe is formed with a third shackle hole therethrough. The cover member is pivotable relative to the slide seat for moving between a closed position and an open position. The first and second lobes extend into the accommodating space so as to be covered by the cover member and so as to dispose the third lobe between the first and second lobes and to enable the third shackle hole to align axially with the first and second shackle holes in order to permit extension of the shackle of the padlock through the first, second, and third shackle holes such that the shackle is shielded by the cover member when the cover member is moved to the closed position while the slide seat is disposed in the engaging position. The third lobe is turned away from the first and second lobes to permit sliding movement of the slide seat between the engaging and disengaging positions when the cover member is moved to the open position after removal of the shackle from the first, second and third lobes.

According to a second aspect of the present invention, a lock assembly includes first and second mounting seats, a padlock, a slide seat, and a cover member. The first mounting seat is adapted to be mounted on a first object, and has a rear sidewall adapted to face the first object, and a front side wall provided with a first lobe that is formed with a first shackle hole therethrough. The first mounting seat is further formed with a first slide channel. The second mounting seat is adapted to be mounted on a second object, and has a rear side wall adapted to face the second object, and a front side wall provided with a second lobe which is formed with a second shackle hole that is axially aligned with the first shackle hole. The second mounting seat is formed with a second slide channel which is aligned and communicated with the first slide channel. The padlock includes a lock body and a shackle mounted on the lock body. The slide seat has a sliding rod which is slidable along the first and second slide channels between an engaging position, in which the sliding rod extends into the first and second slide channels for engaging the first and second mounting seats, and a disengaging position, in which the sliding rod is disposed in the first slide channel and is removed from the second slide channel for disengaging from the second mounting seat so as to permit movement of one of the first and second mounting seats with the corresponding object relative to the other one of the first and second mounting seats. The cover member is mounted pivotally on the slide seat. The cover member has an L-shaped configuration, and includes a first cover portion formed with a central opening, and a second cover portion extending transversely from the first cover portion. The cover member is pivotable relative to the slide seat for moving between a closed position and an open position. The first cover portion is moved to and covers the front side walls of the first and second mounting seats, and enables the first and second lobes to extend through the central opening such that the first and second shackle holes are exposed from the first cover portion in order to permit extension of the shackle of the padlock through the first and second shackle holes when the cover member is moved to the closed position while the slide seat is disposed in the engaging position. The first cover portion is turned away from the first and second lobes to permit sliding movement of the slide seat between the engaging and disengaging positions when the cover member is moved to the open position after removal of the shackle from the first and second lobes.

According to a third aspect of the present invention, a lock assembly includes first and second mounting seats, a slide seat, and a lock device. The first mounting seat is adapted to be mounted on a first object, and has a rear side wall adapted to face the first object, and a front side wall formed with an L-shaped first shackle member. The first shackle member has a first section connected to the front side wall, and a distal second section extending transversely from the first section. The first shackle member cooperates with the front side wall to confine a first latch groove therebetween. The first mounting seat is further formed with a first slide channel. The second mounting seat is adapted to be mounted on a second object, and has a rear side wall adapted to face the second object, and a front side wall formed with an L-shaped second shackle member. The second shackle member has a first section connected to the front sidewall of the second mounting seat, and a distal second section extending transversely from the first section of the second shackle member. The second sections of the first and second shackle members extend toward each other. The second shackle member cooperates with the front side wall of the second mounting seat to confine a second latch groove therebetween. The second mounting seat is formed with a second slide channel which is aligned and communicated with the first slide channel. The slide seat has a sliding rod which is slidable along the first and second slide channels between an engaging position, in which the sliding rod extends into the first and second slide channels for engaging the first and second mounting seats, and a disengaging position, in which the sliding rod extends into the first slide channel and is removed from the second slide channel for disengaging from the second mounting seat so as to permit movement of one of the first and second mounting seats with the corresponding object relative to the other one of the first and second mounting seats. The lock device has a lock casing mounted pivotally on the slide seat so as to be pivotable between open and closed positions, a key-operable lock core mounted in the lock casing, and a latch member mounted in the lock casing and having two opposite locking end portions and an intermediate portion between the locking end portions. The lock core has a central axis and one end that is provided with a latch engaging member. The intermediate portion of the latch member engages the latch engaging member. The lock core is operable to operate the latch engaging member so as to enable the latch member to move between a locking position, in which the locking end portions of the latch member extend respectively into the first and second latch grooves and engage the second sections of the first and second shackle members to prevent the lock casing from moving pivotally to the open position when the lock casing is in the closed position while the slide seat is in the engaging position, and an unlocking position, in which the locking end portions of the latch member are moved outwardly and respectively of the first and second latch grooves and are disengaged from the first and second shackle members to permit pivoting movement of the lock casing to the open position when the lock casing is in the closed position while the slide seat is in the engaging position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
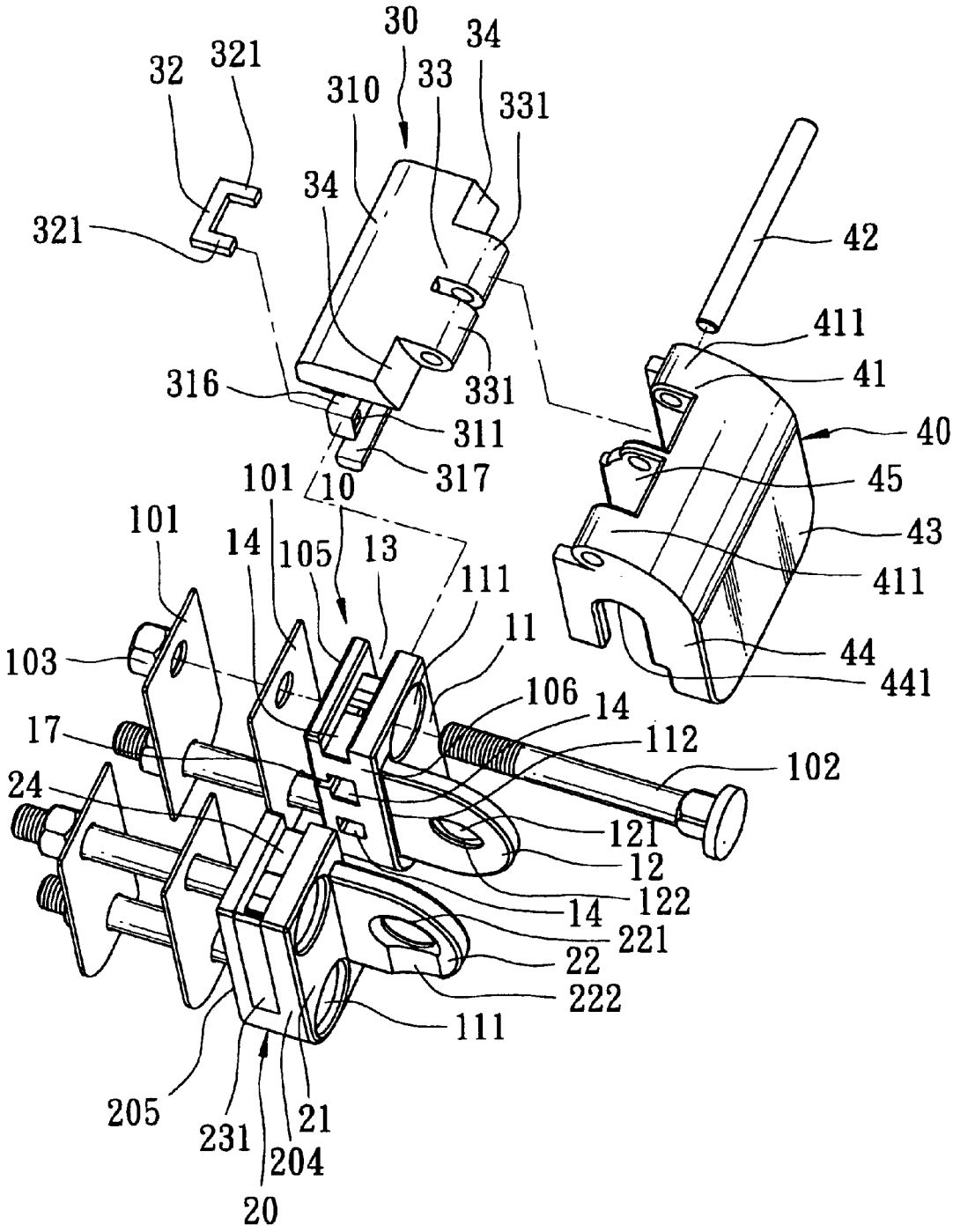
FIG. 1 is an exploded perspective view of a first preferred embodiment of the lock assembly according to the present invention.

Before the present invention is described in greater detail, it should be noted that like elements are denoted by the same reference numerals throughout the disclosure.

Figure 2:
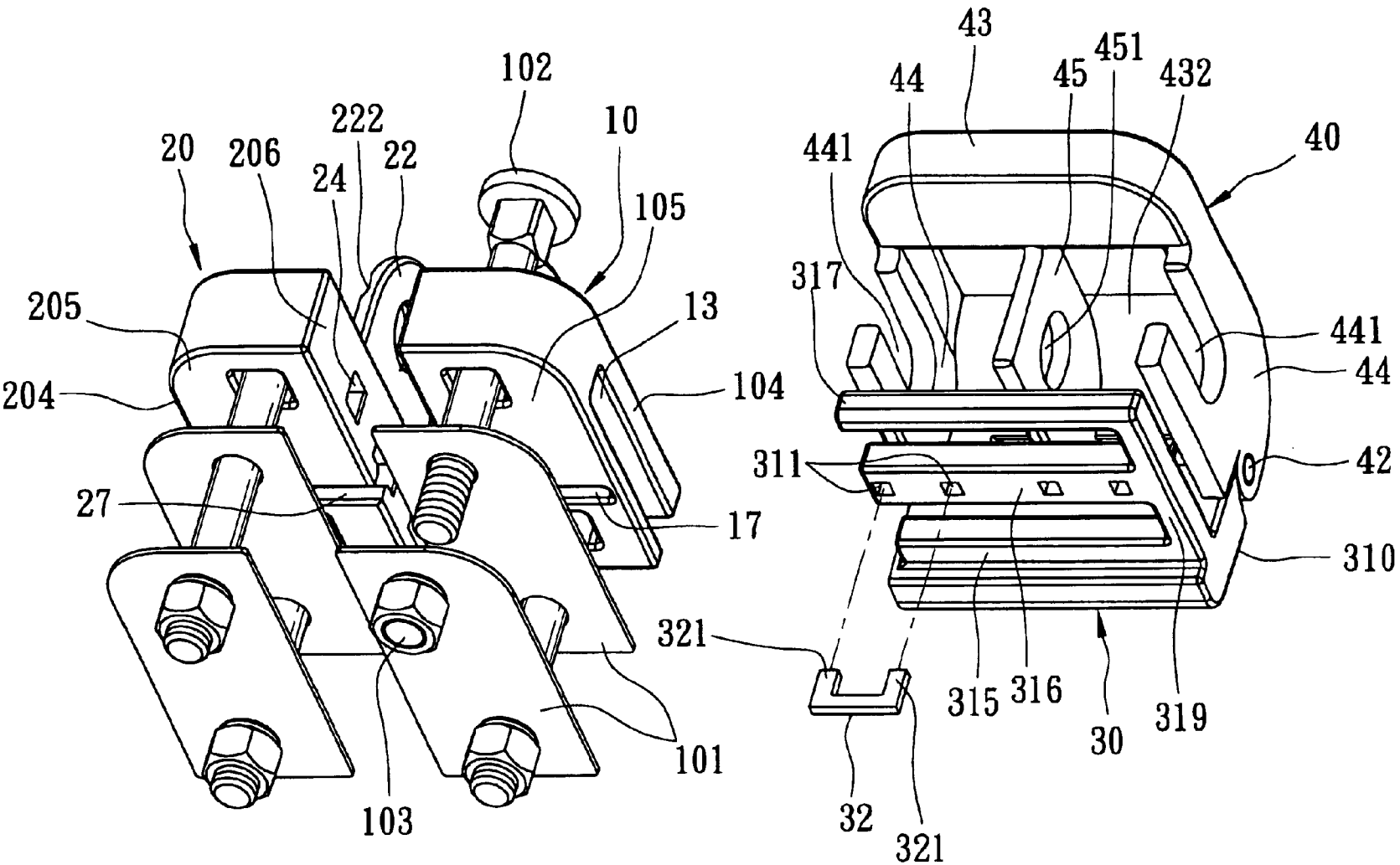
FIG. 2 is an inverted partly exploded perspective view of the first preferred embodiment.
Figure 3:
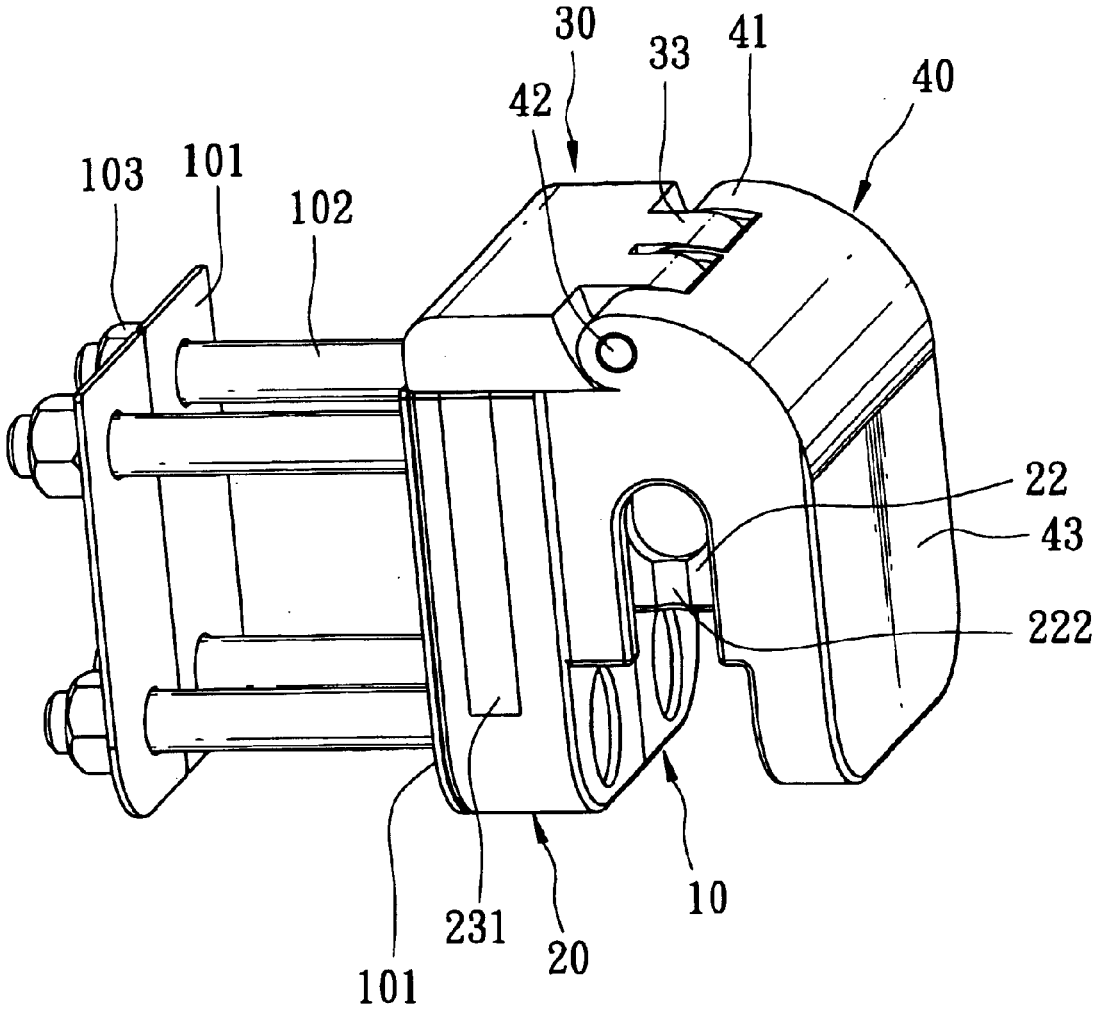
FIG. 3 is a perspective view of the first preferred embodiment.
Figure 4:
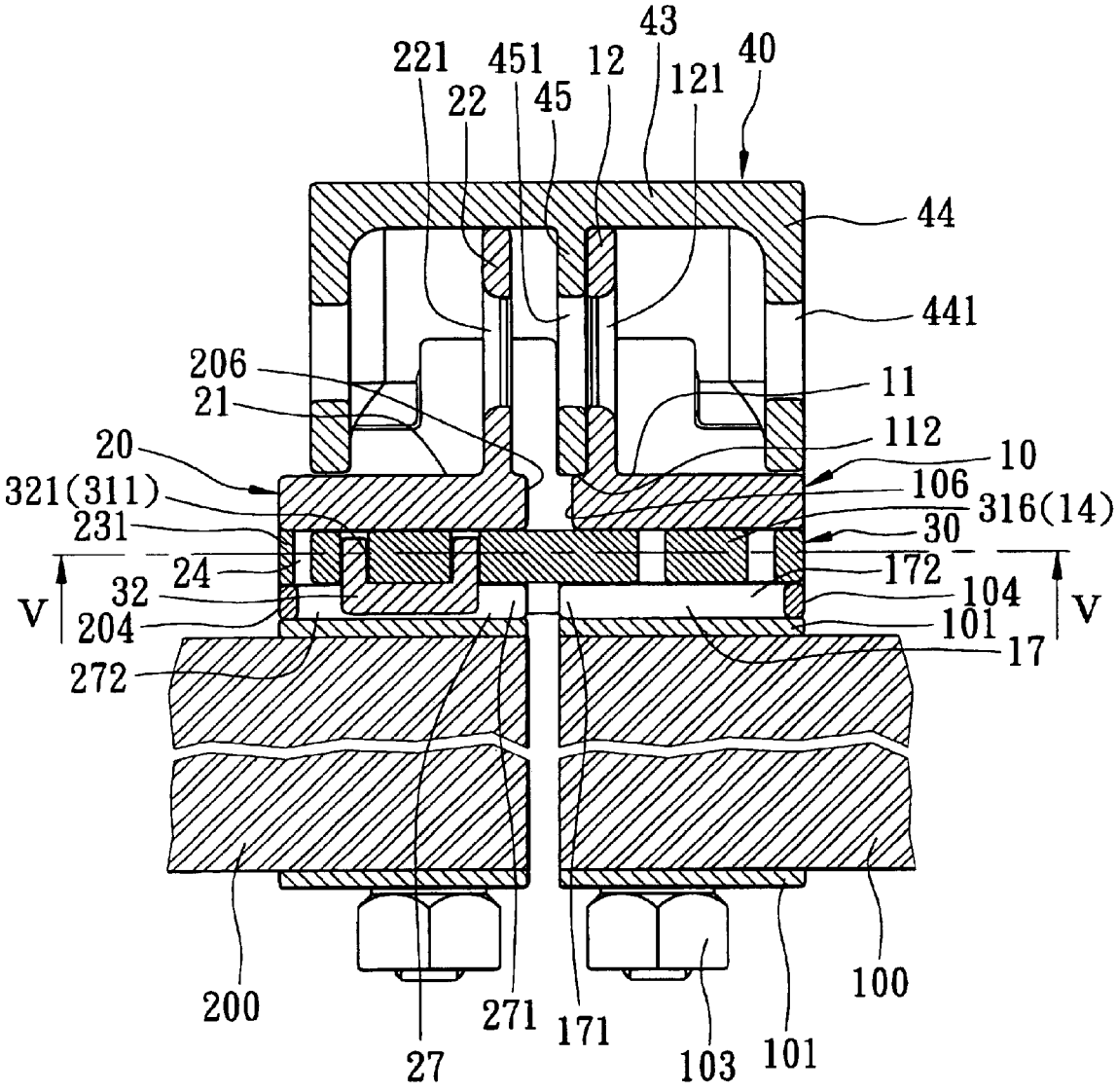
FIG. 4 is a cross-sectional top view of the first preferred embodiment, where two mounting seats are shown to be mounted respectively on two door panels.
Figure 5:
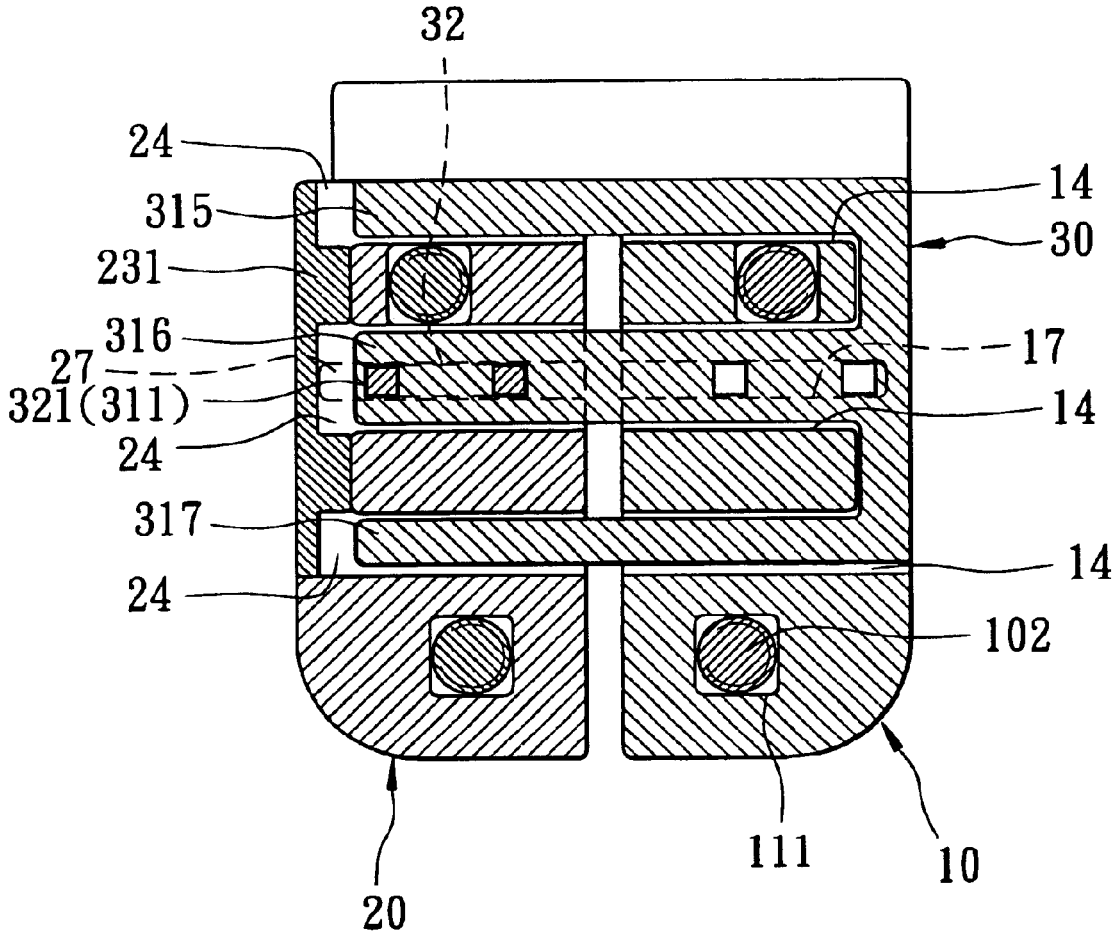
FIG. 5 is a cross-sectional view, taking along line V—V of FIG. 4.

Referring to FIGS. 1 to 3, the first preferred embodiment of the lock assembly according to the present invention is shown to include first and second mounting seats 10, 20, a padlock 50 (see FIG. 6), a slide seat 30, and a cover member 40. Each of the first and second mounting seats 10, 20 is to be mounted on a respective one of two objects to be locked together, such as a door panel and a door frame. In the present embodiment, the lock assembly is illustrated as being used for locking together two door panels 100, 200 (see FIG. 4). Each of the first and second mounting seats 10, 20 is formed with a pair of screw bolt holes 111 for extension of a pair of screw bolts 102 therethrough. A pair of clamping plates 101 are provided behind each of the first and second mounting seats 10, 20. Each of the door panels 100, 200 is disposed between the clamping plates 101 behind a corresponding one of the first and second mounting seats 10, 20 for clamping by the clamping plates 101. The screw bolts 102 extend through the door panels 100, 200, and each has one end engaging a respective nut 103 behind the clamping plates 101 for fastening the first and second mounting seats 10, 20 on the door panels 100, 200, respectively. Each of the first and second mounting seats 10, 20 has a rear side wall 105, 205 adapted to face the corresponding door panel 100, 200, a front side wall 11, 21 opposite to the rear side wall 105, 205, an inner side wall 106, 206 interconnecting inner edges of the front and rear side walls 11, 21, 105, 205, and an outer side wall 104, 204 interconnecting outer edges of the front and rear side walls 11, 21, 105, 205. The mounting seats 10, 20 are disposed on the door panels 100, 200 such that the inner side walls 106, 206 are disposed proximate to and confront each other. The front side wall 11 of the first mounting seat 10 is provided with a first lobe 12 that projects forwardly and that has an oval-shaped first shackle hole 121 formed therethrough. The first mounting seat 10 is further formed with three first slide channels 14 which extend horizontally from the inner side wall 106 toward the outer side wall 104 and which are displaced from one another in a vertical direction. The front side wall 21 of the second mounting seat 20 is provided with a second lobe 22 that has an oval-shaped second shackle hole 221 formed therethrough and aligned with the first shackle hole 121. Each of the first and second lobes 12, 22 has an outer side surface opposite to the other one of the first and second lobes 12, 22 and formed with an indented shackle recess 122, 222 which extends downwardly from the corresponding shackle hole 121, 221 to a lower edge of the corresponding lobe 12, 22. The second mounting seat 20 is further formed with three second slide channels 24 which extend horizontally from the inner side wall 206 toward the outer side wall 204 and which are displaced from one another in a vertical direction. The first slide channels 14 are aligned respectively with the second slide channels 24. Each of the first and second slide channels 14, 24 extends through the inner sidewall 106, 206 of the corresponding one of the first and second mounting seats 10, 20. The outer side wall 104 of the first mounting seat 10 is formed with an entrance 13 communicated with each of the first slide channels 14. The outer side wall 204 of the second mounting seat 20 is provided with a cover plate 231 that defines a closed end of each of the second slide channels 24. In another embodiment, the cover plate 231 may be formed integrally with the second mounting seat 20, i.e., integral with the outer side wall 204 of the second mounting seat 20. The rear side wall 105, 205 of each of the first and second mounting seats 10, 20 is formed with a limiting hole 17, 27 that extends along and that is communicated with a middle one of the slide channels 14, 24 in a corresponding one of the mounting seats 10, 20. The limiting holes 17, 27 are aligned with each other. Referring to FIGS. 4 and 5, each limiting hole 17, 27 has a communicating end 171, 271 formed through the inner side wall 106, 206 of the corresponding mounting seat 10, 20, and an opposite limiting end 172, 272 that is proximate to the outer side wall 104, 204 of the corresponding mounting seat 10, 20 and that is not formed through the outer side wall 104, 204. Referring to FIGS. 1 and 4, the front side wall 11 of the first mounting seat 10 is further formed with a vertically extending positioning groove 112 which is disposed adjacent to an inner side surface of the first lobe 12 that faces the second lobe 22.

Referring back to FIGS. 1 to 3, the slide seat 30 has a horizontal top wall 310 formed with a first pivot portion 33 at one end, a connecting rod 319 extending downwardly from the top wall 310, and three parallel sliding rods 315, 316, 317 which are disposed horizontally below the top wall 310 and which are spaced apart vertically from one another. Each of the sliding rods 315, 316, 317 has a connecting end portion connected to the connecting rod 319, and a distal end portion distal from the connecting rod 319. During assembly, the sliding rods 315, 316, 317 are inserted into the first slide channels 14 via the entrance 13. The distal end portion of a middle one of the sliding rods 316 is formed with an engaging hole unit which consists of a pair of engaging holes 311. A stop member 32, which is formed as a U-shaped metal body, engages the engaging hole unit by extending two opposite ends 321 thereof into the pair of engaging holes 311 of the engaging hole unit through one of the limiting holes 17, 27 after the sliding rods 315, 316, 317 are inserted into the slide channels 14. The stop member 32 thus projects from the middle one of the sliding rods 316, and projects into one of the limiting holes 17, 27. The sliding rods 315, 316, 317 are slidable along the first and second slide channels 14, 24. As best illustrated in FIG. 4, the stop member 32 is movable with the middle one of the sliding rods 316 between the limiting ends 172, 272 of the limiting holes 17, 27, thereby preventing removal of the slide seat 30 from the first mounting seat 10, and thereby limiting sliding movement of the slide seat 30 between an engaging position and a disengaging position. In the engaging position, as shown in FIGS. 4 and 5, the sliding rods 315, 316, 317 extend into the first slide channels 14 and into the second slide channels 24 for engaging both the first and second mounting seats 10, 20, and the stop member 32 is disposed adjacent to the limiting end 272 of the limiting hole 27 in the second mounting seat 20. In the disengaging position, as shown in FIG. 10, the sliding rods 315, 316, 317 extend only into the first slide channels 14 and are removed from the second slide channels 24 for disengaging from the second mounting seat 20, and the stop member 32 is disposed proximate to the limiting end 172 of the limiting hole 17 in the first mounting seat 10.

Referring back to FIGS. 1 to 3, the cover member 40 has an upper end formed with a second pivot portion 41 which is mounted pivotally on the first pivot portion 33 by means of a horizontal pivot axle 42 such that the cover member 40 is turnable relative to the slide seat 30 about an axis of the pivot axle 42 in an upward direction for moving to an open position and in a downward direction for moving to a closed position. The first pivot portion 33 on the slide seat 30 has a pair of inclined end walls 34 facing the second pivot portion 41, and a pair of pivot tubes 331 projecting integrally from the end walls 34 and formed with aligned pivot holes for extension of the pivot axle 42 therethrough. The inclined end walls 34 incline downwardly and forwardly. Each end wall 34 has a concave surface. The second pivot portion 41 of the cover member 40 is formed integrally with a pair of second pivot tubes 411 which flank the first pivot tubes 331 and which are disposed respectively adjacent to the inclined end walls 34. The cover member 40 is further formed with a third lobe 45 inserted into a clearance formed between the first pivot tubes 331. The second pivot tubes 411 and the third lobe 45 are formed with aligned pivot holes which are aligned with the pivot holes in the first pivot tubes 331 for extension of the pivot axle 42 therethrough. In case there is a thief who tried to damage the lock assembly by cutting the pivot tubes 331, 411 using a saw, the inclined end walls 34 would abut against the saw and may cause bending of the saw during the cutting operation, there by preventing the thief from successfully damaging the lock assembly.

The cover member 30 is generally formed as a hollow casing with a convex front cover plate 43 and a pair of spaced-apart side cover plates 44 which extend transversely from opposite left and right edges of the front cover plate 43. The side cover plates 44 cooperate with the front cover plate 43 to confine an accommodating space 432. The accommodating space 432 opens downwardly and rearwardly when the cover member 40 is turned downwardly to the closed position. The third lobe 45 is disposed in the accommodating space 432, and extends integrally and rearwardly from an inner surface of the front cover plate 43. The third lobe 45 is formed with a third shackle hole 451. Each of the side cover plates 44 is formed with a slot 441 that has a size corresponding to the size of the shackle 52 of the padlock 50 and that permits extension of the shackle 52 therethrough. When the cover member 40 is turned to the closed position after the slide seat 30 is moved to the engaging position, the first and second lobes 12, 22 extend into the accommodating space 432, and the third lobe 45 extends into a clearance formed between the first and second lobes 12, 22 and is positioned in the positioning groove 112 to enable axial alignment of the third shackle hole 451 with the first and second shackle holes 121, 221. At this time, the shackle 52 of the padlock 50 is extendible through the shackle holes 121, 451, 221 for locking together the first and second mounting seats 10, 20 and the cover member 40, thereby locking together the first and second door panels 100, 200. When the cover member 40 is turned upwardly to the open position after the padlock 50 is unlocked using a corresponding key and is removed from the lobes 12, 22, 45, the third lobe 45 is moved upwardly away from the first and second lobes 12, 22 for removal from the clearance between the first and second lobes 12, 22 so as to permit sliding movement of the slide seat 30 to the disengaging position, where the slide seat 30 is disengaged from the second mounting seat 20 to permit movement of the second mounting seat 20 together with the second door panel 200 relative to the first mounting seat 10 and the first door panel 100.

Figure 6:
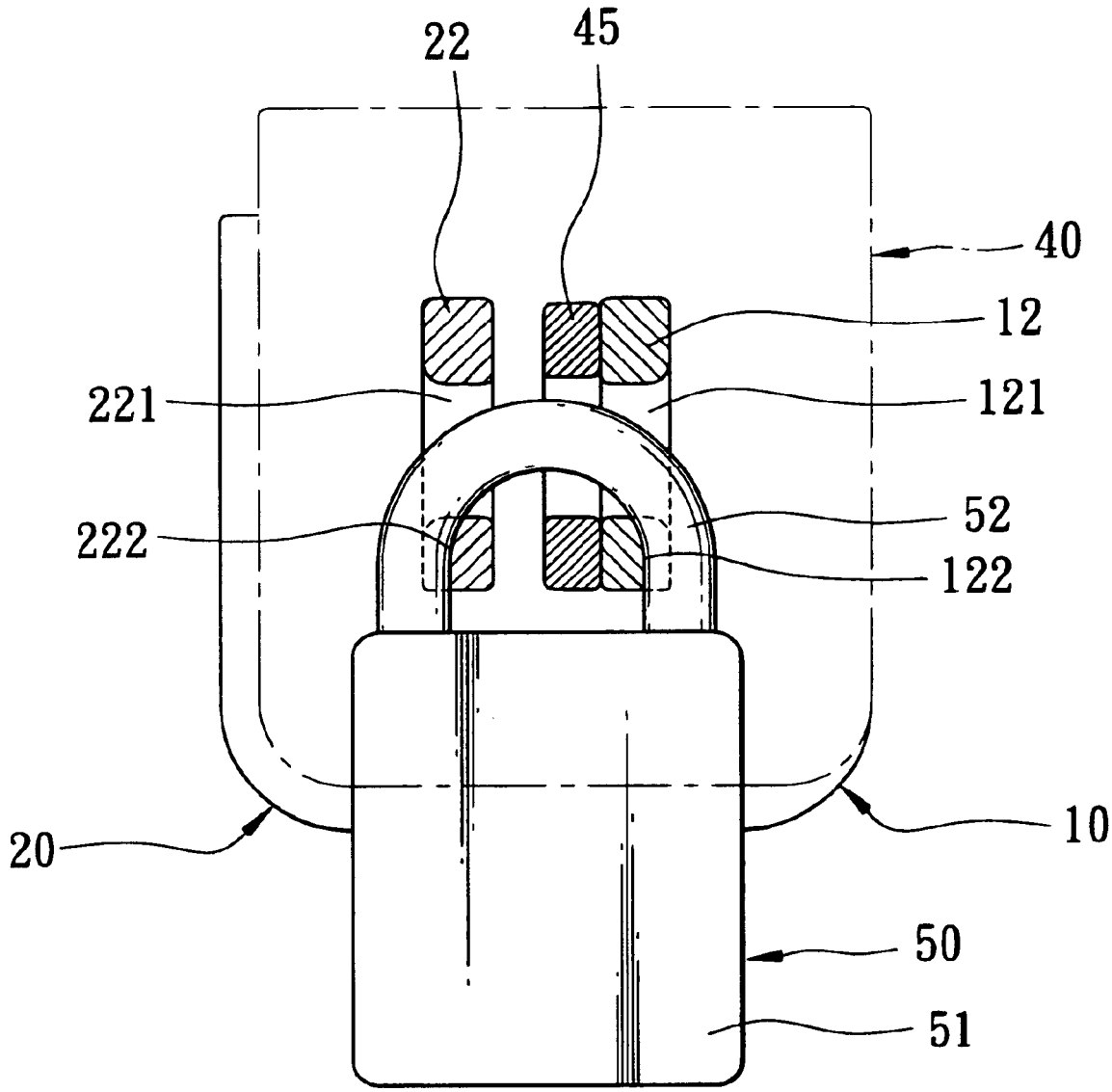
FIG. 6 is a schematic view illustrating how the shackle of a padlock can be shielded by a cover member in the first preferred embodiment when the padlock is in a locking state.
Figure 7:
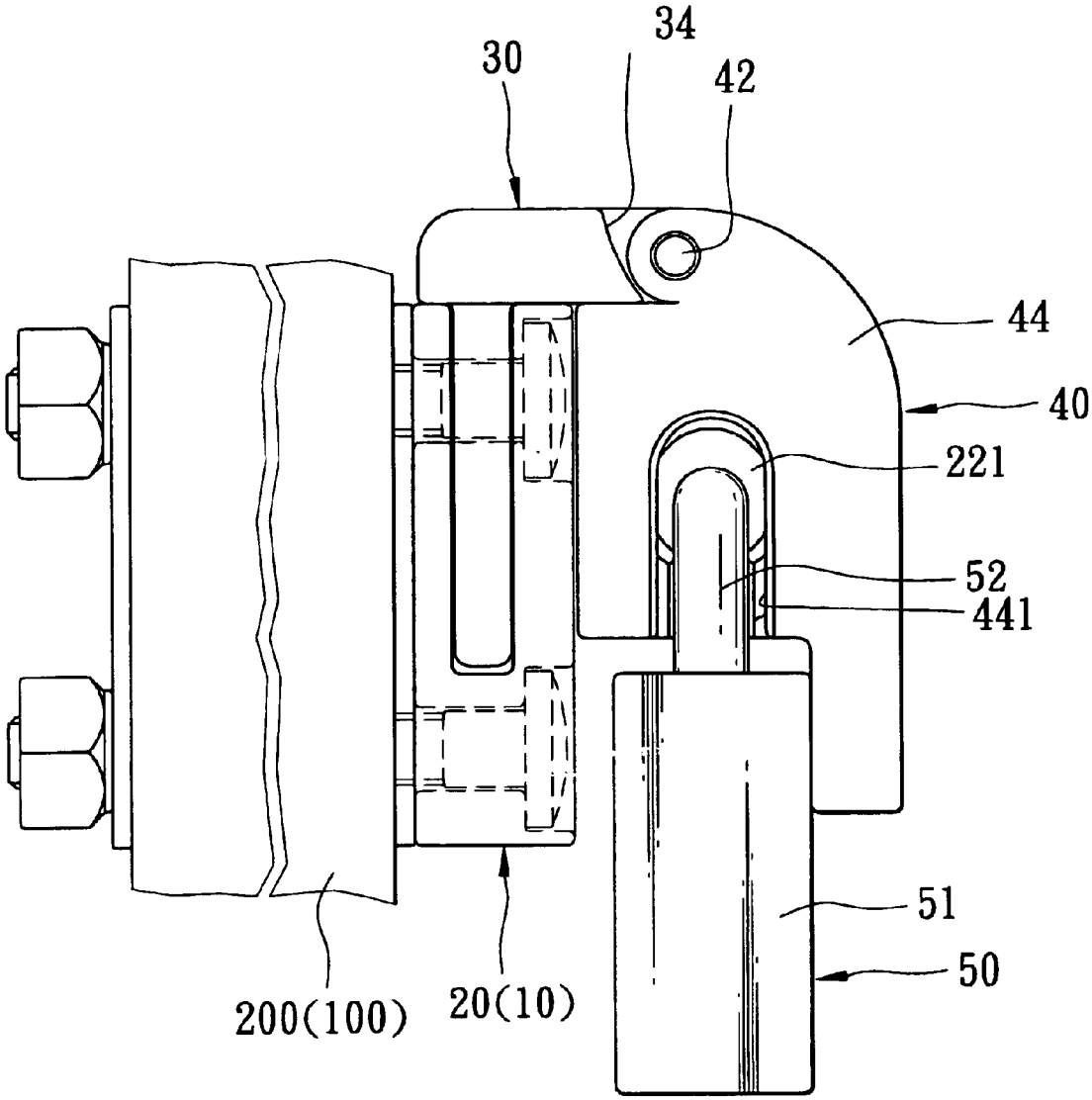
FIG. 7 is a lateral side view of FIG. 6.
Figure 10:
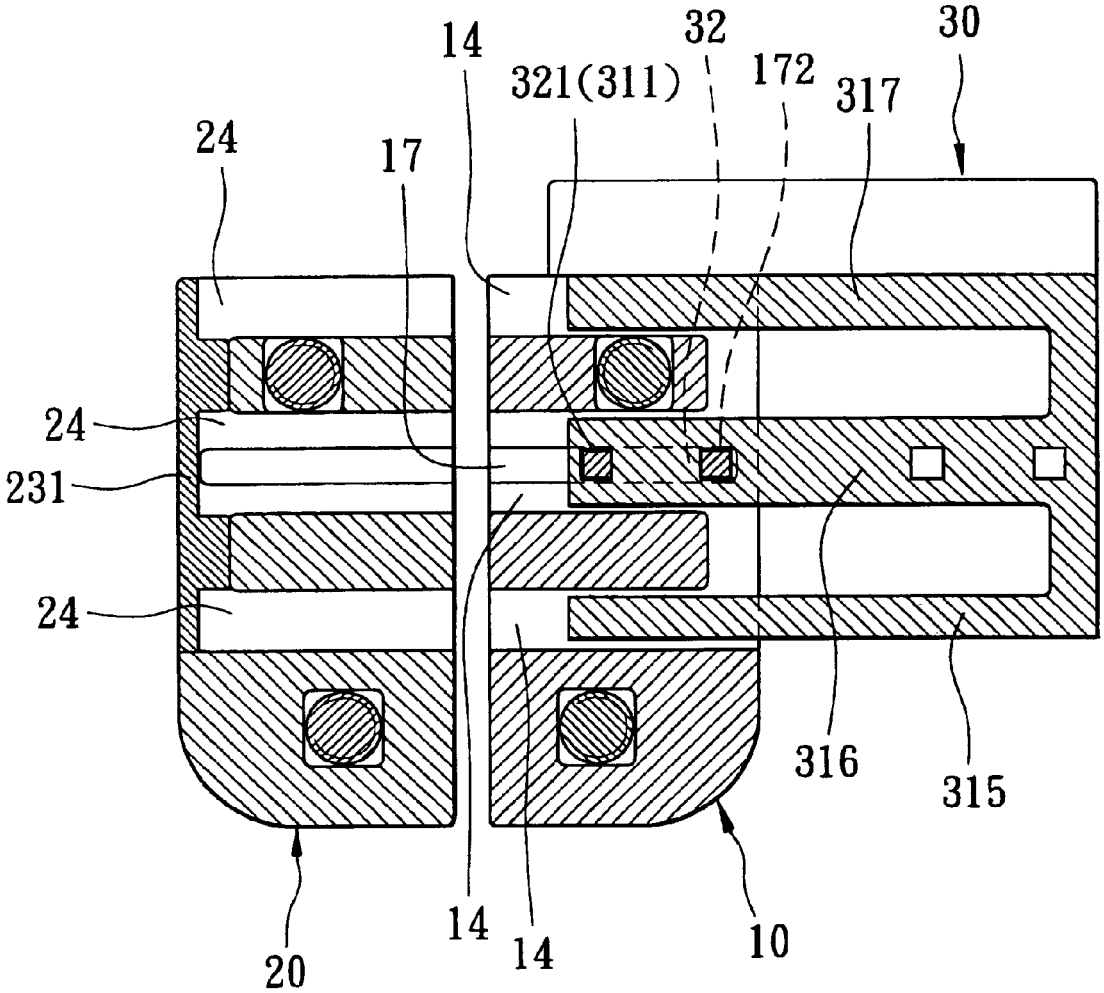
FIG. 10 is a sectional view of FIG. 9, viewed from a front side of the lock assembly.

In use, the slide seat 30 is initially slid to the first mounting seat 10 and is disposed in the disengaging position, as shown in FIG. 10. To lock the door panels 100, 200 to each other, the door panels 100, 200 are disposed side by side to align the shackle holes 121, 221 in the first and second lobes 12, 22 with each other. The slide seat 30 is then slid from the first mounting seat 10 toward the second mounting seat 20 with the cover member 40 turned to the open position, such that the sliding rods 315, 316, 317 are extended from the first slide channels 14 into the second slide channels 24 to dispose the slide seat 30 in the engaging position, as shown in FIG. 5. The cover member 40 is then turned downwardly to the closed position, where the third lobe 45 is disposed between the first and second lobes 12, 22, and where the shackle hole 451 in the third lobe 45 is aligned with the shackle holes 121, 221 in the first and second lobes 12, 22, as shown in FIGS. 3 and 4. The shackle 52 of the padlock 50, which is in an unlocking state, is extended into the accommodating space 432 through the slots 441, and is extended through the shackle holes 121, 451, 221. The padlock 50 is then locked by simply forcing the padlock 51 upward to engage the shackle 52 with a lock body 51 of the padlock 50 in a known manner, thereby locking together the first and second door panels 100, 200, as shown in FIGS. 6 and 7. At this time, the shackle 52 is partially buried in the shackle recesses 122, 222, and is substantially shielded by the cover member 40. With the formation of the shackle recesses 122, 222, the lobes 12, 22 can be made thicker to have a higher strength so as to obtain an enhanced anti-theft effect. As the slots 441 in the side cover plates 44 correspond in size with the cross-section of the shackle 52, it is difficult to extend a cutting tool, such as a hydraulic cutter, into the accommodating space 432 through any of the slots 441 to cut the shackle 52. The padlock 50 can thus be effectively prevented from being destroyed by cutting.

Figure 8:
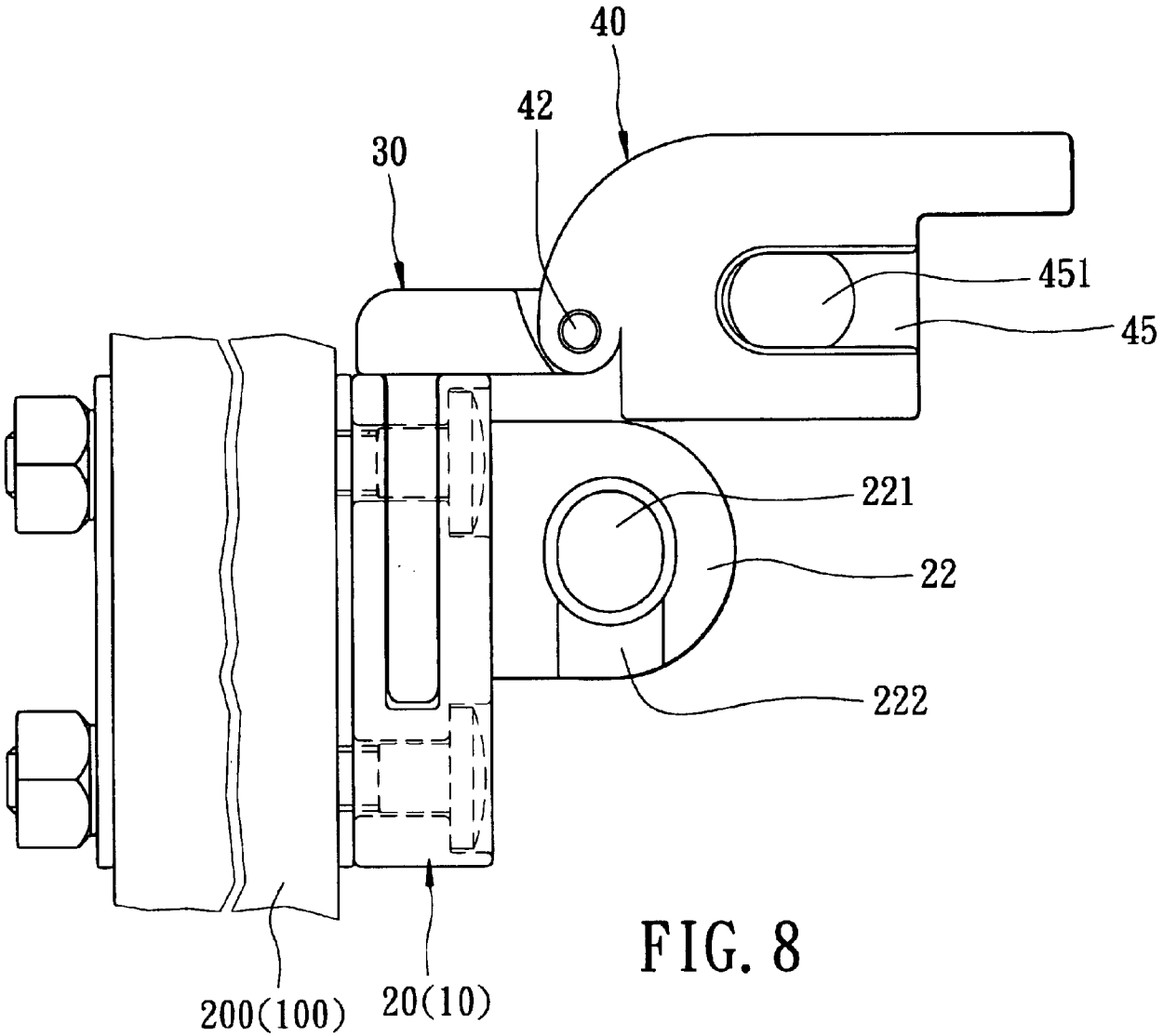
FIG. 8 is a lateral side view of the first preferred embodiment, illustrating upward turning of the cover member when the padlock is removed.
Figure 9:
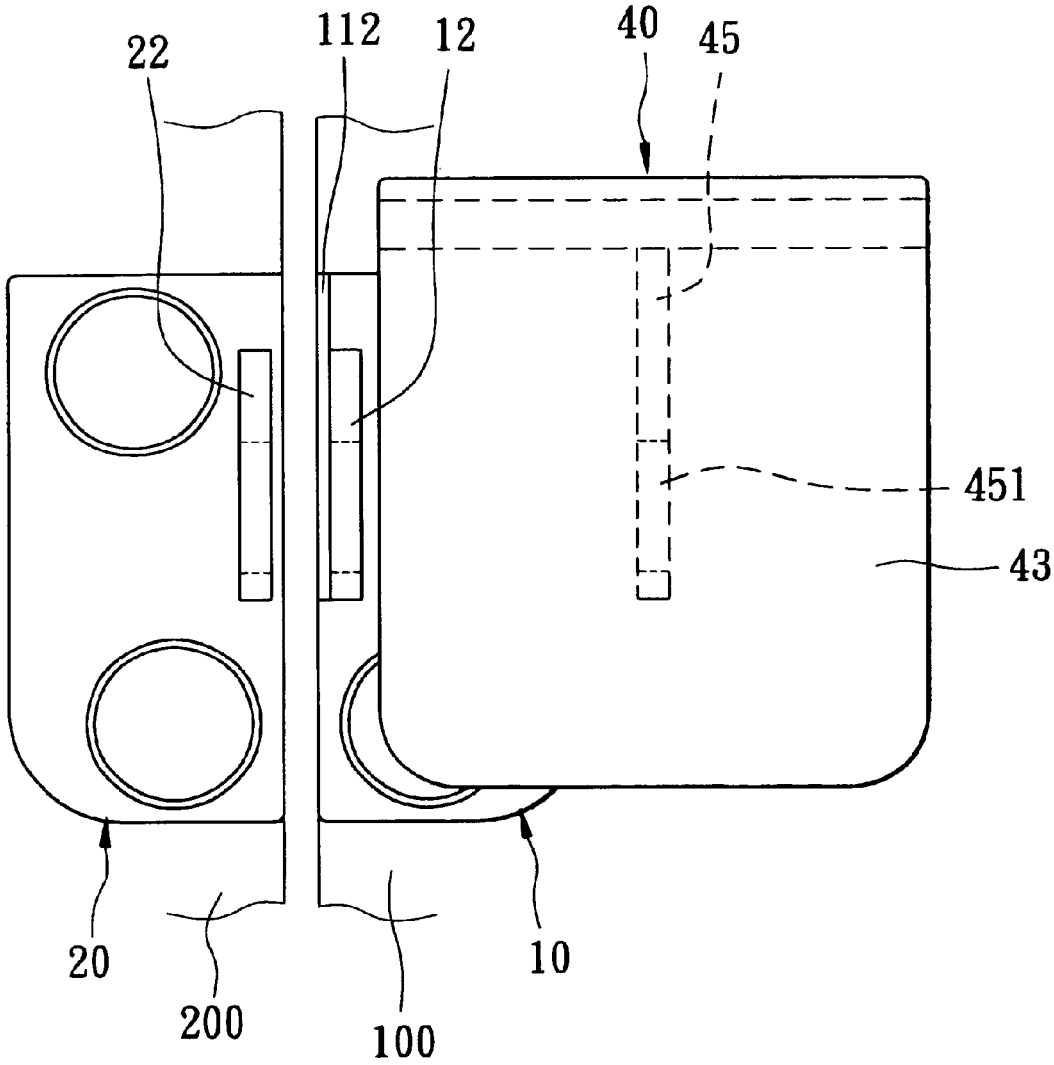
FIG. 9 is a schematic front view of the first preferred embodiment, where the cover member is turned upward and a slide seat is slid rightward to disengage from a left one of the door panels.
Figure 11:
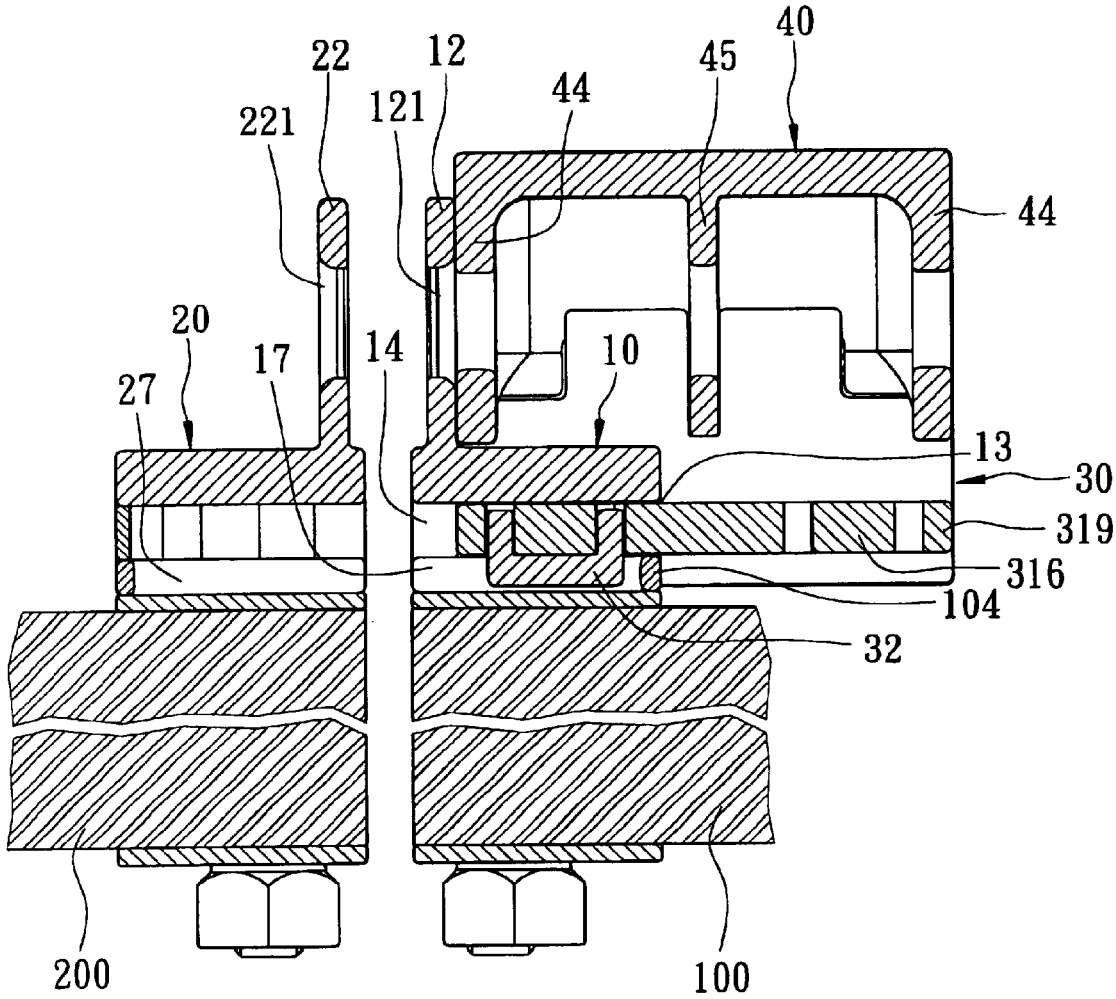
FIG. 11 is a cross-sectional view of FIG. 9, viewed from a bottom side of the lock assembly.

Referring to FIGS. 7 and 8, when the padlock 50 is unlocked using the corresponding key, one end of the shackle 52 is disengaged from the lock body 51 of the padlock 50. The shackle 52 is then removed from the lobes 12, 22, 45, and thus from the first and second mounting seats 10, 20 and the cover member 40. Thereafter, the cover member 40 is turned upwardly for moving to the open position. The slide seat 30 is then slid horizontally toward the first mounting seat 10 for disengaging from the second mounting seat 20, as shown in FIG. 10. When the slide seat 30 is moved to the disengaging position, the cover member 40 may be turned downwardly again, and the shackle 52 of the padlock 50 may be extended once again through the third lobe 45 such that the padlock 50 can be carried by the first door panel 100 without interfering with movement of the second door panel 200, as shown in FIGS. 9 and 11.

The door assembly to which the present embodiment is applied is in the form of a right-side-turning door, in which the right side door panel, i.e., the first door panel 100, is turnable relative to a door frame or a fixed left-side door panel, i.e., the second door panel 200, about a vertical axis. In this case, the entrance 13 for access into the first and second slide channels 14, 24 is formed in the outer side wall 104 of the first mounting seat 10, and the slide seat 30 is slid rightwardly to the first mounting seat 10 after the padlock 50 is removed so as to prevent the cover member 40 and the slide seat 30 from hindering or interfering with turning movement of the first door panel 100 relative to the second door panel 200.

Figure 12:
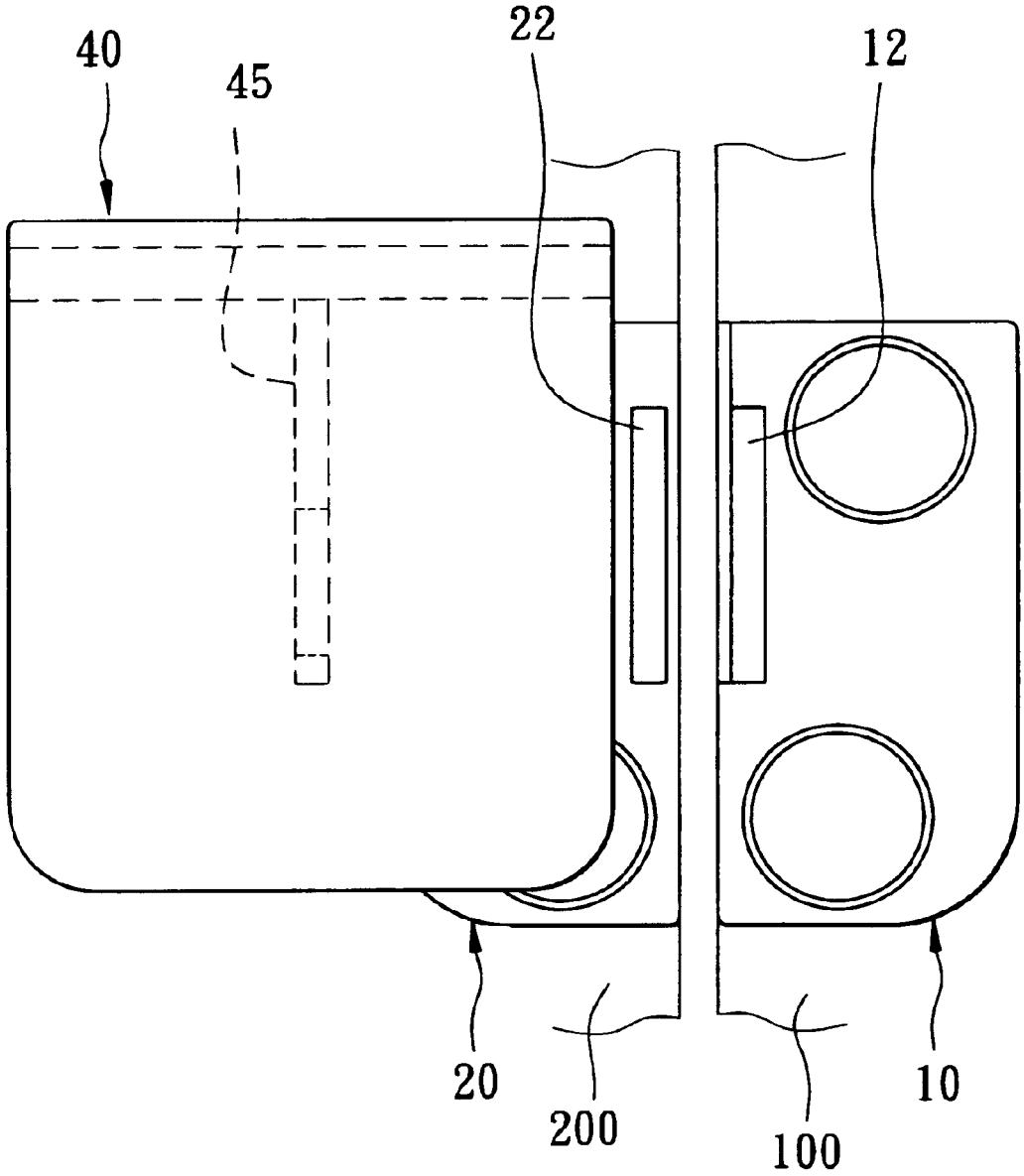
FIG. 12 is a schematic front view of a second preferred embodiment of the lock assembly of the present invention when mounted on a left-side-turning door assembly, where a cover member thereof is shown to be turned downward after a slide seat is slid leftward.
Figure 13:
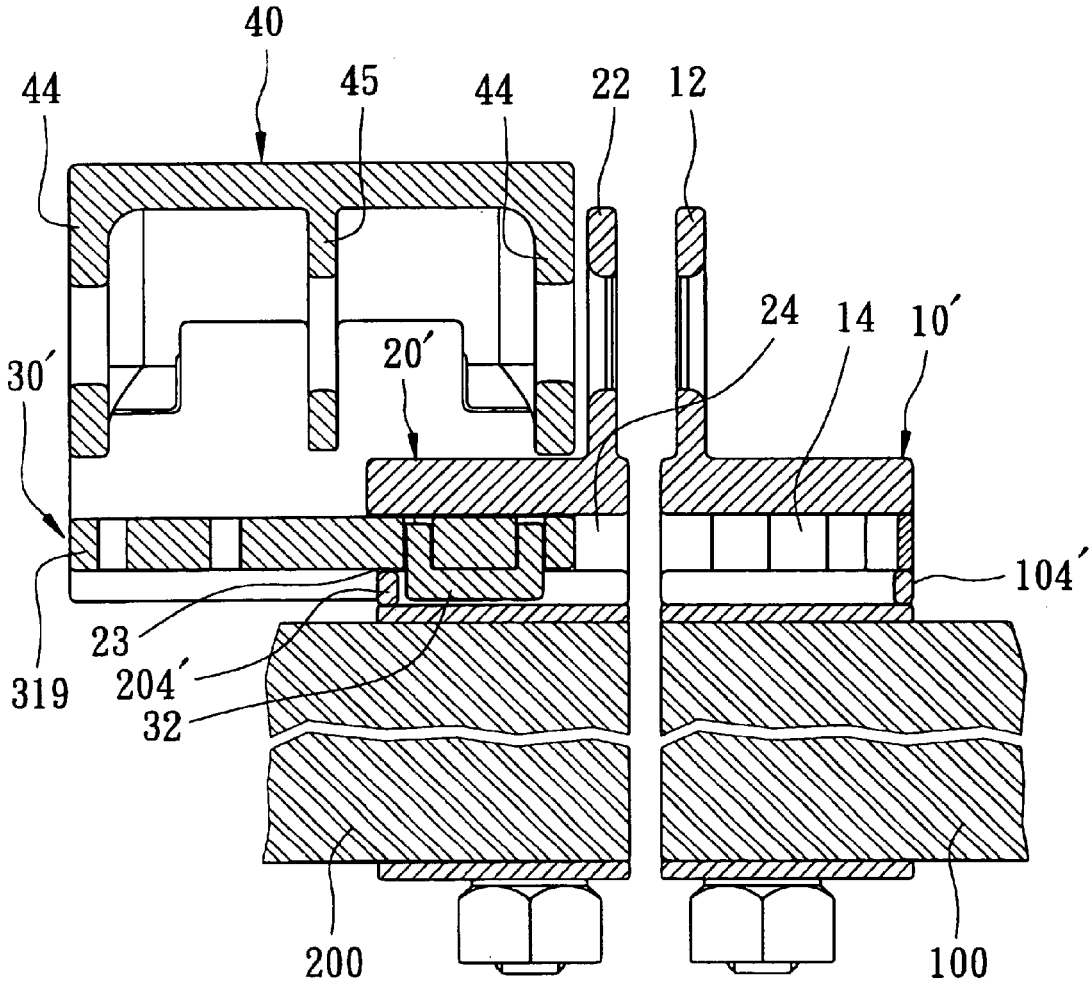
FIG. 13 is a cross-sectional view of FIG. 12, viewed from a bottom side of the lock assembly.

Referring to FIGS. 12 and 13, a second preferred embodiment of the lock assembly of the present invention is shown to be applied to a left-side-turning door assembly, in which a left-side door panel, i.e., the second door panel 200, is turnable relative to a door frame or a fixed right-side door panel, i.e., the first door panel 100. In this embodiment, the outer side wall 104' of the first mounting seat 10' is sealed, and an entrance 23 for access into the slide channels 24, 14 is formed in the outer side wall 204' of the second mounting seat 20'. The connecting rod 319 is disposed at a left end of the slide seat 30' to interconnect left end portions of the sliding rods. The slide seat 30' is slid leftwardly to the second mounting seat 20' after removal of the padlock 50 (see FIG. 7) so as to prevent the cover member 40 and the slide seat 30' from interfering with movement of the second door panel 200 relative to the first door panel 100.

It has thus been shown that, with the use of the slide seat 30, 30', which is slidable horizontally, and the cover member 40, which is turnable upwardly and downwardly, the cover member 40 can be prevented from interfering with movement of one of the door panels 100, 200 relative to the other. Moreover, since the slots 441 are sized to permit extension of the shackle 52 while preventing a cutting tool from extending thereinto for cutting the shackle 52, the shackle 52 of the padlock 50 can be safely protected by the cover member 40.

Figure 14:
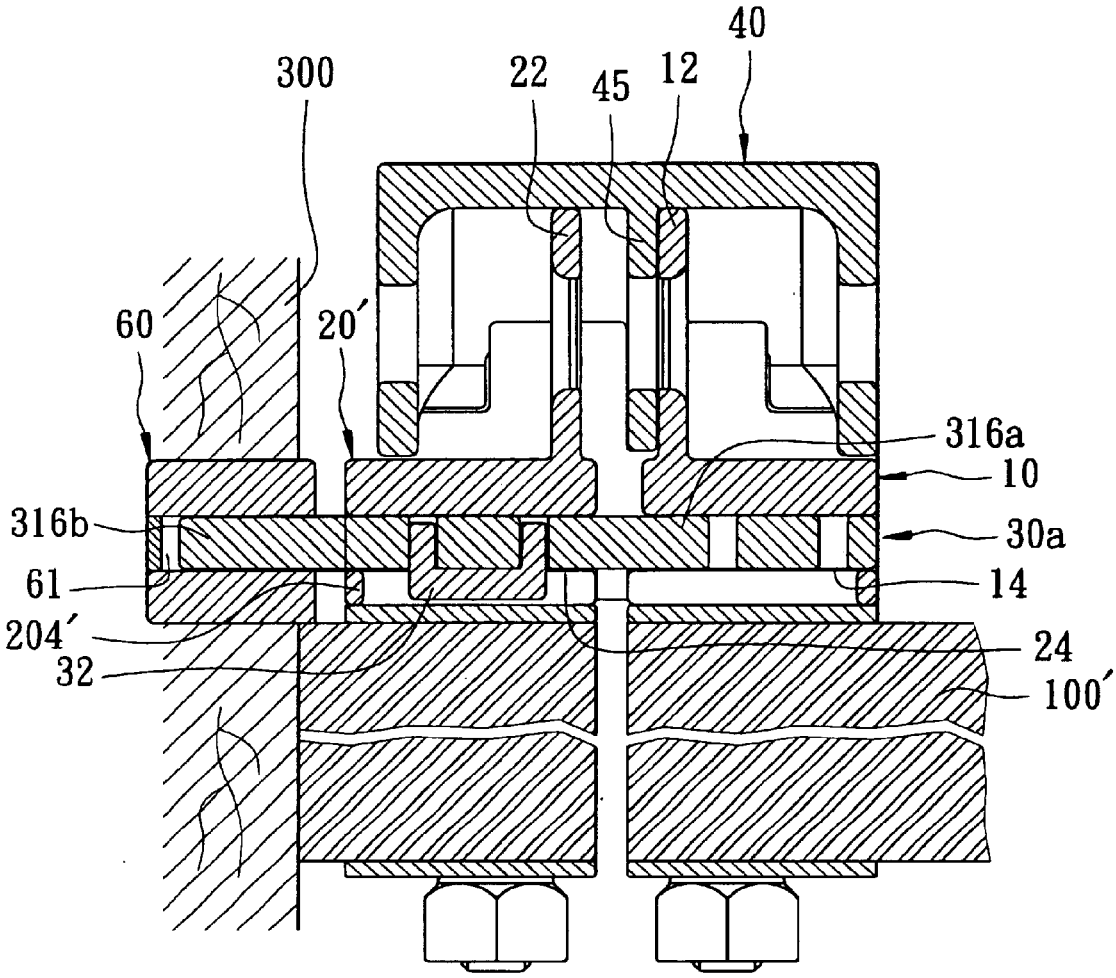
FIG. 14 is a cross-sectional view of a third preferred embodiment of the lock assembly of the present invention, viewed from a bottom side of the lock assembly.
Figure 15:
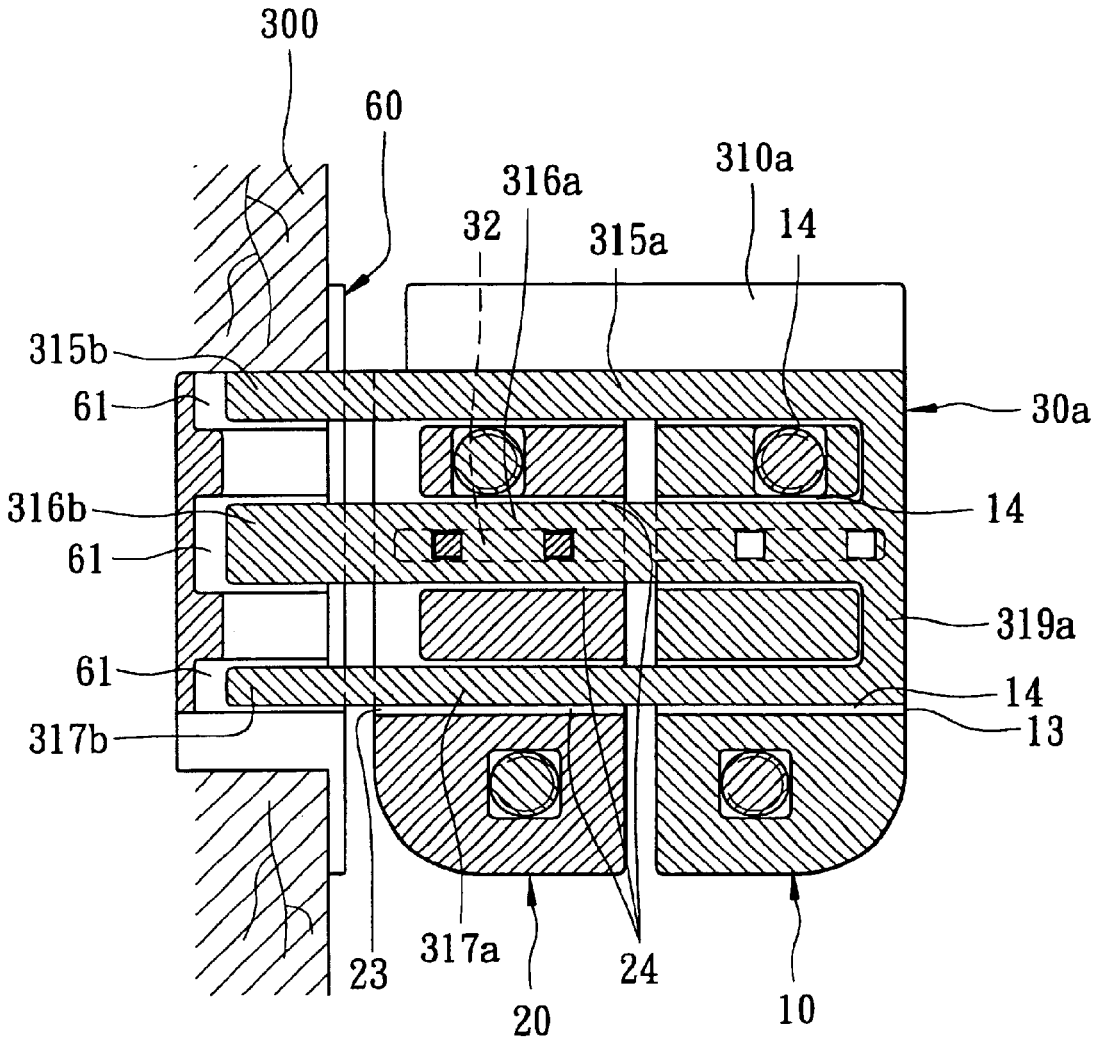
FIG. 15 is a vertical sectional view of the third preferred embodiment, viewed from a front side of the lock assembly.

Referring to FIGS. 14 and 15, a third preferred embodiment of the present invention is shown to be adapted to be applied to a door assembly with a door panel 100' turnable relative to a fixed door frame 300. In this case, both the first and second mounting seats 10, 20' are mounted on the door panel 100'. The slide seat 30*a* similarly has a top wall 310*a*, a connecting rod 319*a* extending downwardly from the top wall 310*a*, and three horizontally extending sliding rods 315*a*, 316*a*, 317*a* disposed below the top wall 310*a* and connected to the connecting rod 319*a*. Each of the sliding rods 315*a*, 316*a*, 317*a* has a connecting end portion connected to the connecting rod 319*a*, a distal latch end 315*b*, 316*b*, 317*b* opposite to the connecting end portion, and an intermediate portion. The intermediate portion of a middle one of the sliding rods 316*a* is similarly provided with a stop member 32 to limit sliding movement of the slide seat 30*a* between the engaging and disengaging positions. A latch seat 60 is adapted to be mounted fixedly on the door frame 300, and is formed with three rectangular latch holes 61 aligned respectively with the second slide channels 24. In the present embodiment, the outer side wall 204' of the second mounting seat 20' is open, and the sliding rods 315*a*, 316*a*, 317*a* of the slide seat 30*a* extend longer through the outer side wall 204' of the second mounting seats 20', and project relative to the outer side wall 204' when the slide seat 30*a* is moved to the engaging position. At this time, the latch ends 315*b*, 316*b*, 317*b* of the sliding rods 315*a*, 316*a*, 317*a* are extendible respectively into the latch holes 61 for locking the door panel 100' to the door frame 300.

Figure 16:
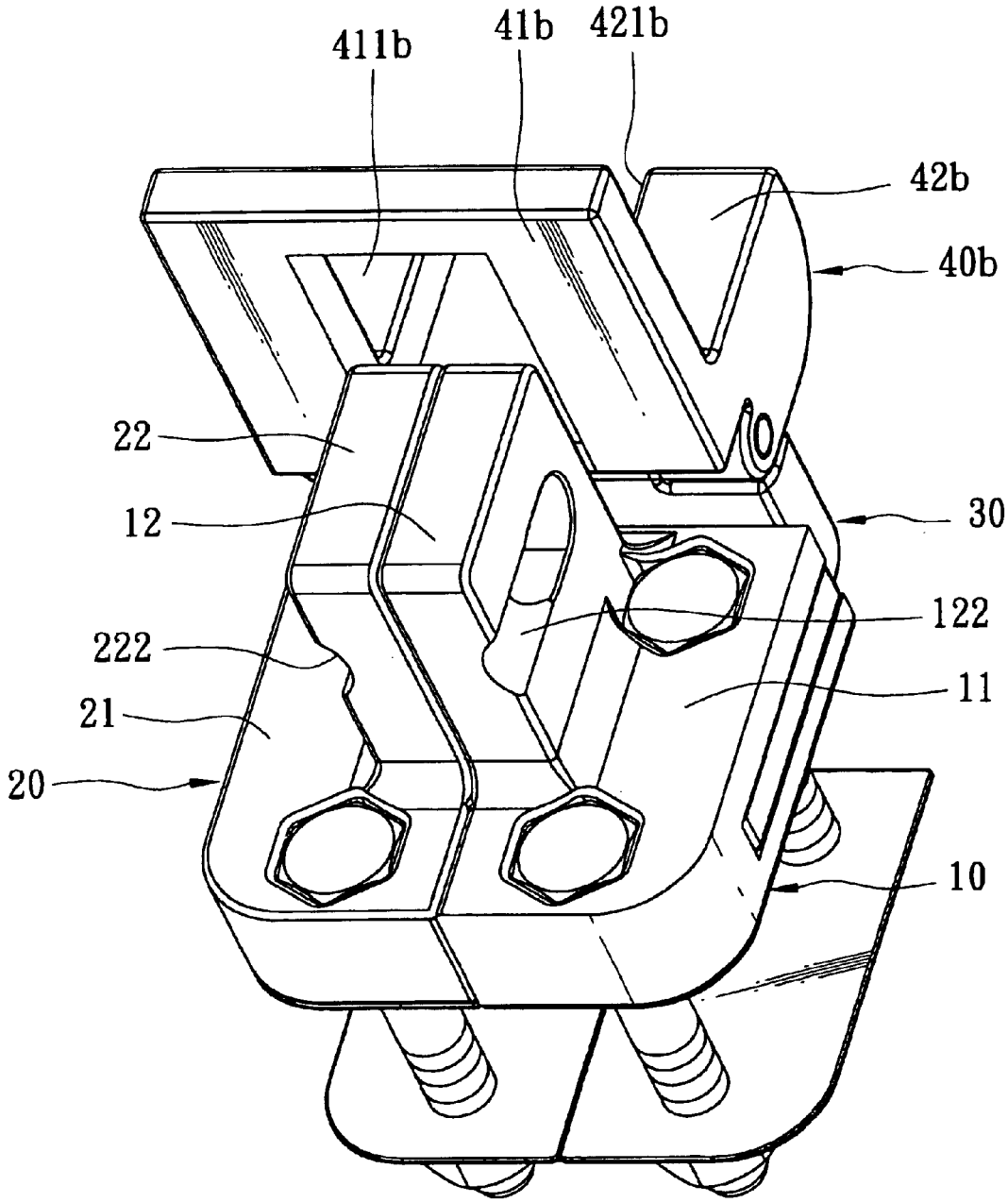
FIG. 16 is a perspective view of a fourth preferred embodiment of the lock assembly according to the present invention, where a cover member is shown to be turned upwardly to an open position.
Figure 17:
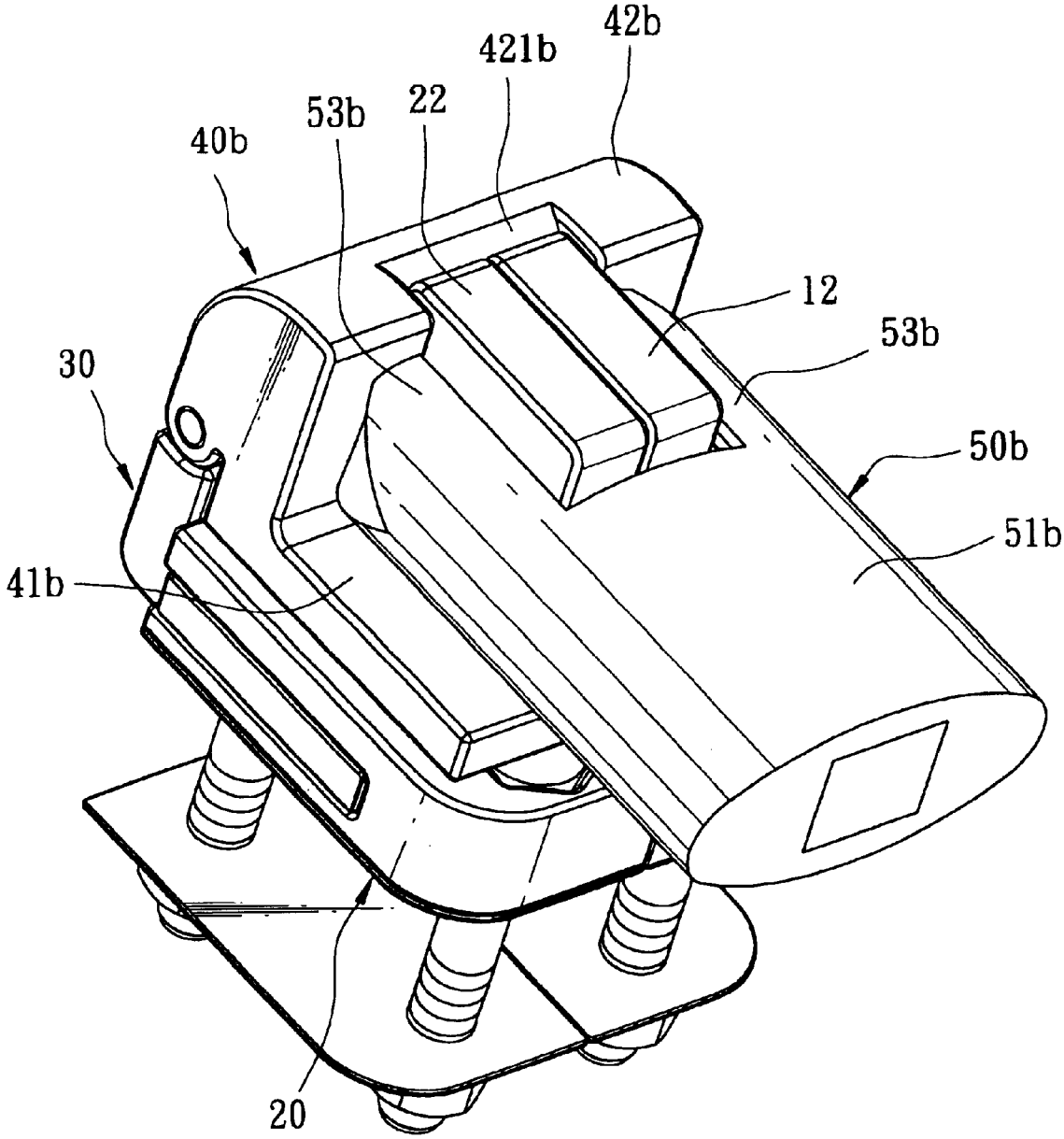
FIG. 17 is another perspective view of the fourth preferred embodiment when incorporating a padlock, where the cover member is turned downwardly to a closed position.
Figure 18:
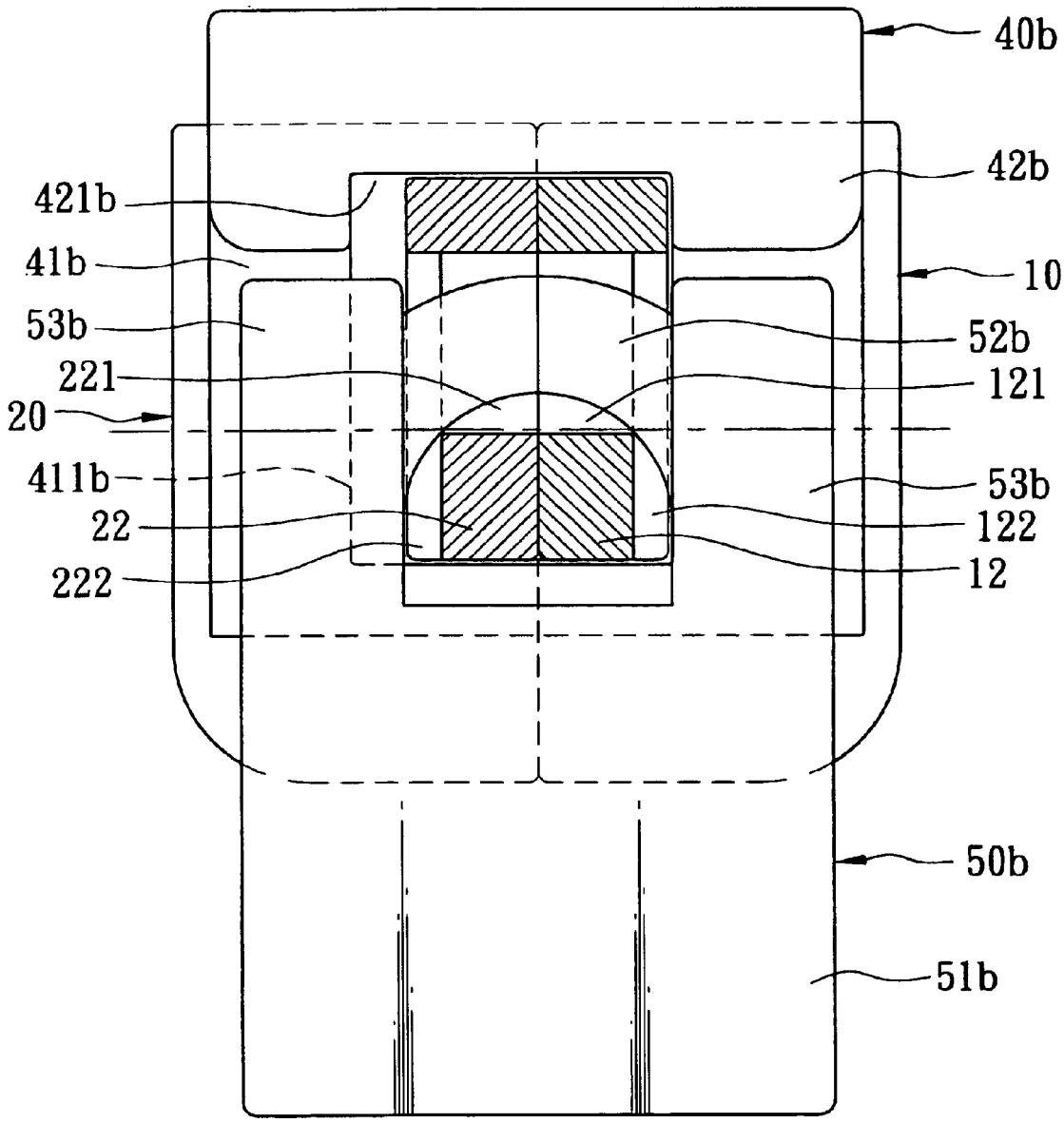
FIG. 18 is a partly-sectioned front view of the fourth preferred embodiment.

Referring to FIGS. 16 to 18, a fourth preferred embodiment of the lock assembly according to the present invention is shown to include a first mounting seat 10, a second mounting seat 20, a slide seat 30, a cover member 40*b*, and a padlock 50*b* with a U-shaped shackle 52*b*. Each of the first and second mounting seats 10, 20 and the slide seat 30 has a structure similar to that in the first preferred embodiment shown in FIG. 1. The cover member 40*b* is mounted pivotally on the slide seat 30 so as to be turnable downwardly to a closed position, and to be turnable upwardly to an open position. The cover member 40*b* has an L-shaped configuration, and includes a first cover portion 41*b* formed with a central opening 411*b*, and a second cover portion 42*b* extending transversely from the first cover portion 41*b* and formed with a notch 421*b* communicated with the central opening 411*b*. When the cover member 40*b* is turned downwardly to the closed position while the slide seat 30 is slid to the engaging position, the first cover portion 41*b* is moved to the front side walls 11, 21 of the first and second mounting seats 10, 20, covers the front side walls 11, 21, and enables the first and second lobes 12, 22 to extend through the central opening 411*b* such that the first and second shackle holes 121, 221 are exposed from the first cover portion 411*b*. In this manner, the first and second lobes 12, 22 are bound to each other by the first cover portion 41*b*. At this time, the shackle 52*b* of the padlock 50*b* is extendible through the first and second shackle holes 121, 221, with the padlock 50*b* initially operated to be in an unlocking state. The padlock 50*b* has a lock body 51*b* with a U-shaped casing that includes a pair of lateral guarding portions 53*b* that guard lateral sides of the shackle 52*b*. When the padlock 50*b* is subsequently operated to be in the locking state, the shackle 52*b* is partially buried in the shackle recesses 122, 222, and is substantially shielded in all directions by the guarding portions 53*b* of the lock body 51*b*, the first and second lobes 12, 22, and the first cover portion 41*b* of the cover member 40*b*, cooperatively, as shown in FIGS. 17 and 18. In this state, the first and second lobes 12, 22 are extended into the notch 421*b* in the second cover portion 42*b* of the cover member 40*b*. The first cover portion 41*b* is clamped between the padlock 50*b* and the front side walls 11, 21 of the first and second mounting seats 10, 20, and is prevented from upward turning for moving to the open position.

Figure 19:
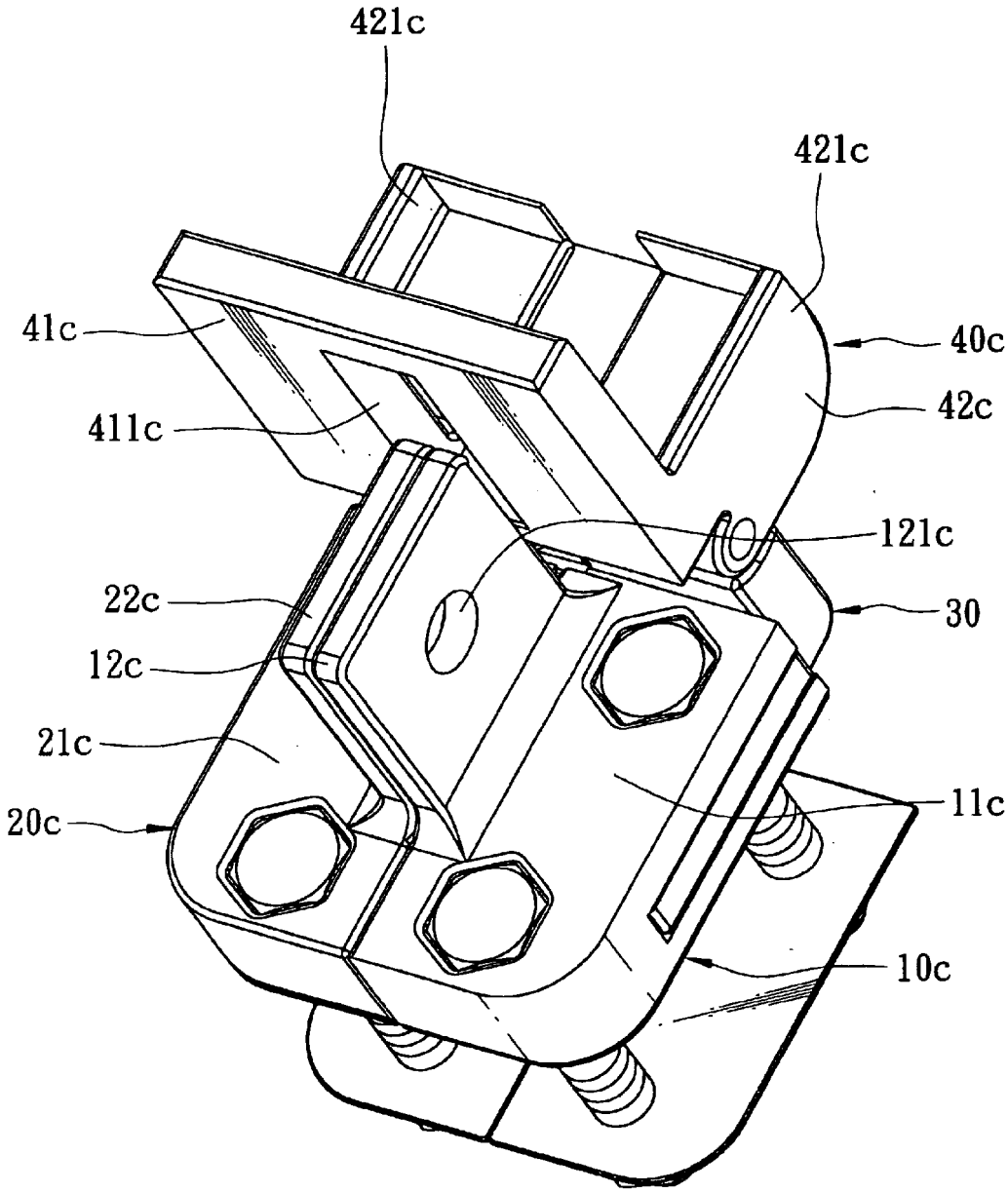
FIG. 19 is a perspective view of a fifth preferred embodiment of the lock assembly according to the present invention, where a cover member is shown to be turned upwardly to an open position.
Figure 20:
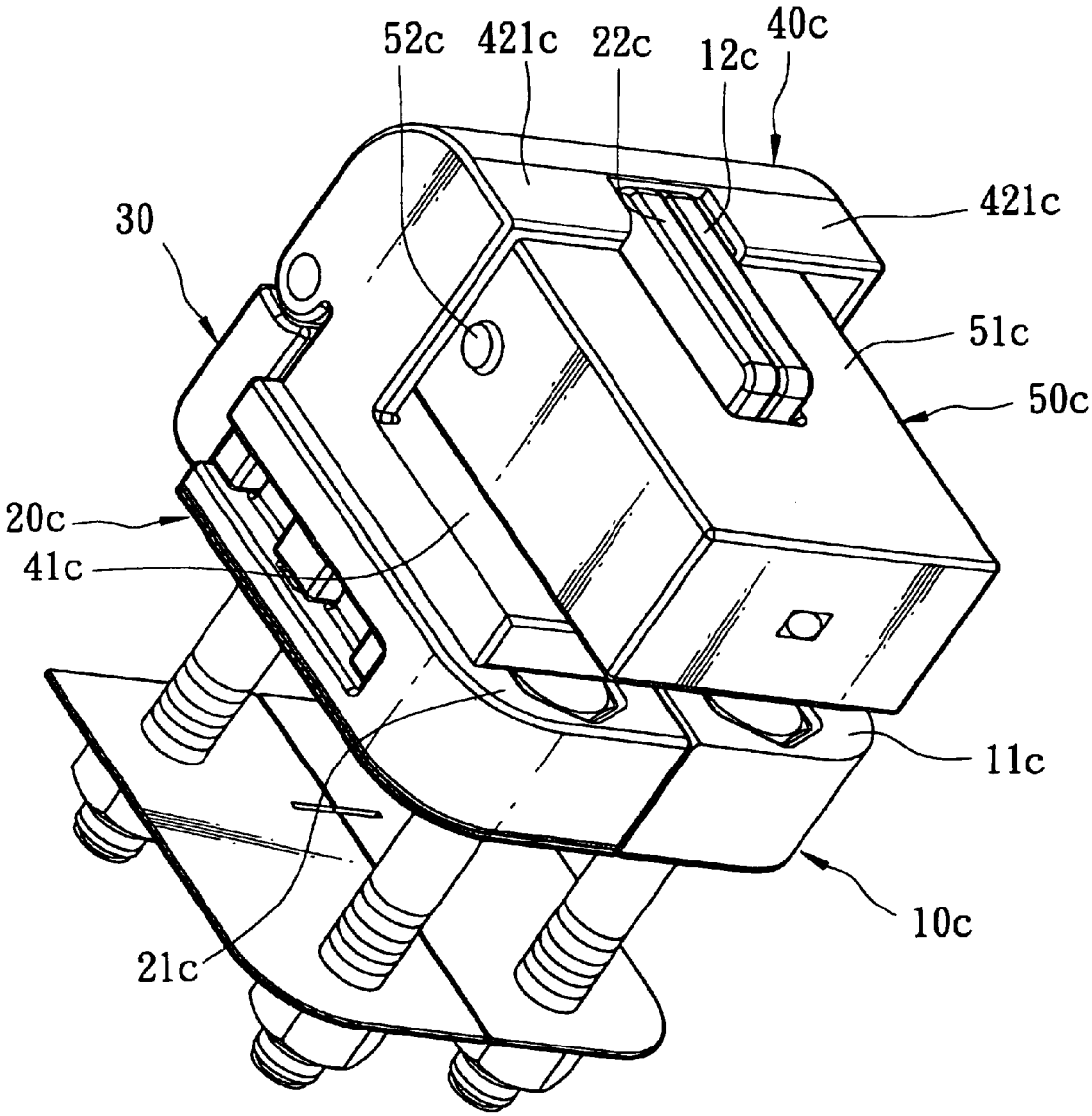
FIG. 20 is another perspective view of the fifth preferred embodiment when incorporating a padlock, where the cover member is turned downwardly to a closed position.
Figure 21:
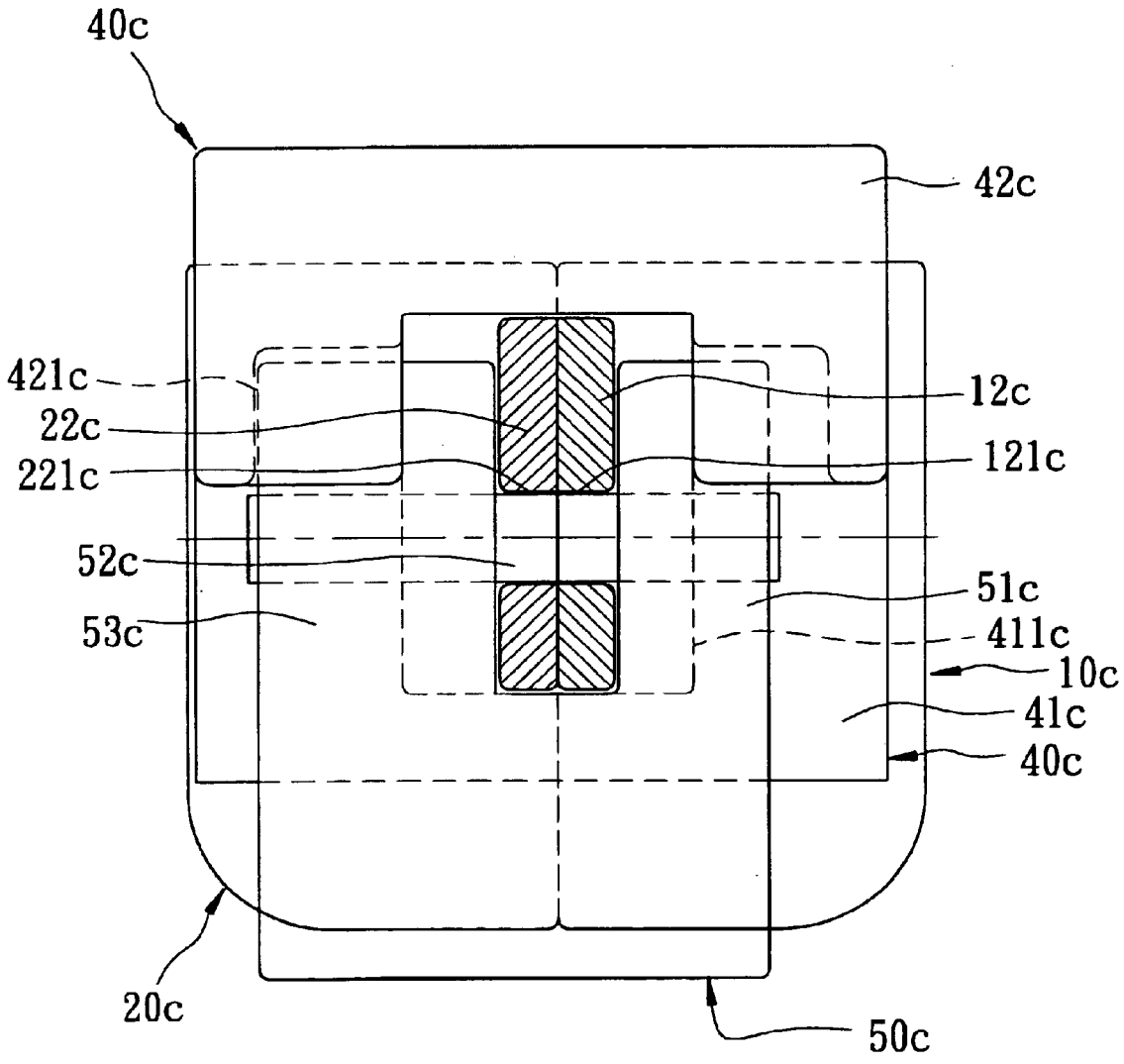
FIG. 21 is a partly-sectioned front view of the fifth preferred embodiment.

Referring to FIGS. 19 to 21, the fifth preferred embodiment of the lock assembly of the present invention is generally similar to the previous embodiment in construction, and includes first and second mounting seats 10*c*, 20*c*, a slide seat 30, a cover member 40*c*, and a padlock 50*c*. The padlock 50*c* includes a U-shaped lock body 51*c* and a shackle 52*c* formed as an elongated bar. The first and second lobes 12*c*, 22*c* on the first and second mounting seats 10*c*, 20*c* are not formed with shackle recesses. The cover member 40*c* similarly has an L-shaped configuration, and includes a first cover portion 41*c* for covering front side walls 11*c*, 21*c* of the first and second mounting seats 10*c*, 20*c*, and a second cover portion 42*c* transverse to the first cover portion 41*c*. The first and second lobes 12*c*, 22*c* are extended through a central opening 411*c* in the first cover portion 41*c*, and the shackle 52*c* of the padlock 50*c* is extendible through shackle holes 121*c*, 221*c* in the first and second lobes 12*c*, 22*c* when the cover member 40*c* is moved to the closed position while the slide seat 30*c* is slid to the engaging position for locking together the first and second mounting seats 10*c*, 20*c* and the cover member 40*c*. Likewise, in this state, the first cover portion 41*c* is clamped between the padlock 50*c* and the front side walls 11*c*, 21*c* of the first and second mounting seats 10*c*, 20*c* to prevent upward turning of the cover member 40*c* to the open position. In the present embodiment, the second cover portion 42*c* is formed with a pair of protecting rims 421*c* which extend downwardly when the cover member 40*c* is moved to the closed position in order to cover and protect an upper end portion of the lock body 51*c* of the padlock 50*c*.

Figure 22:
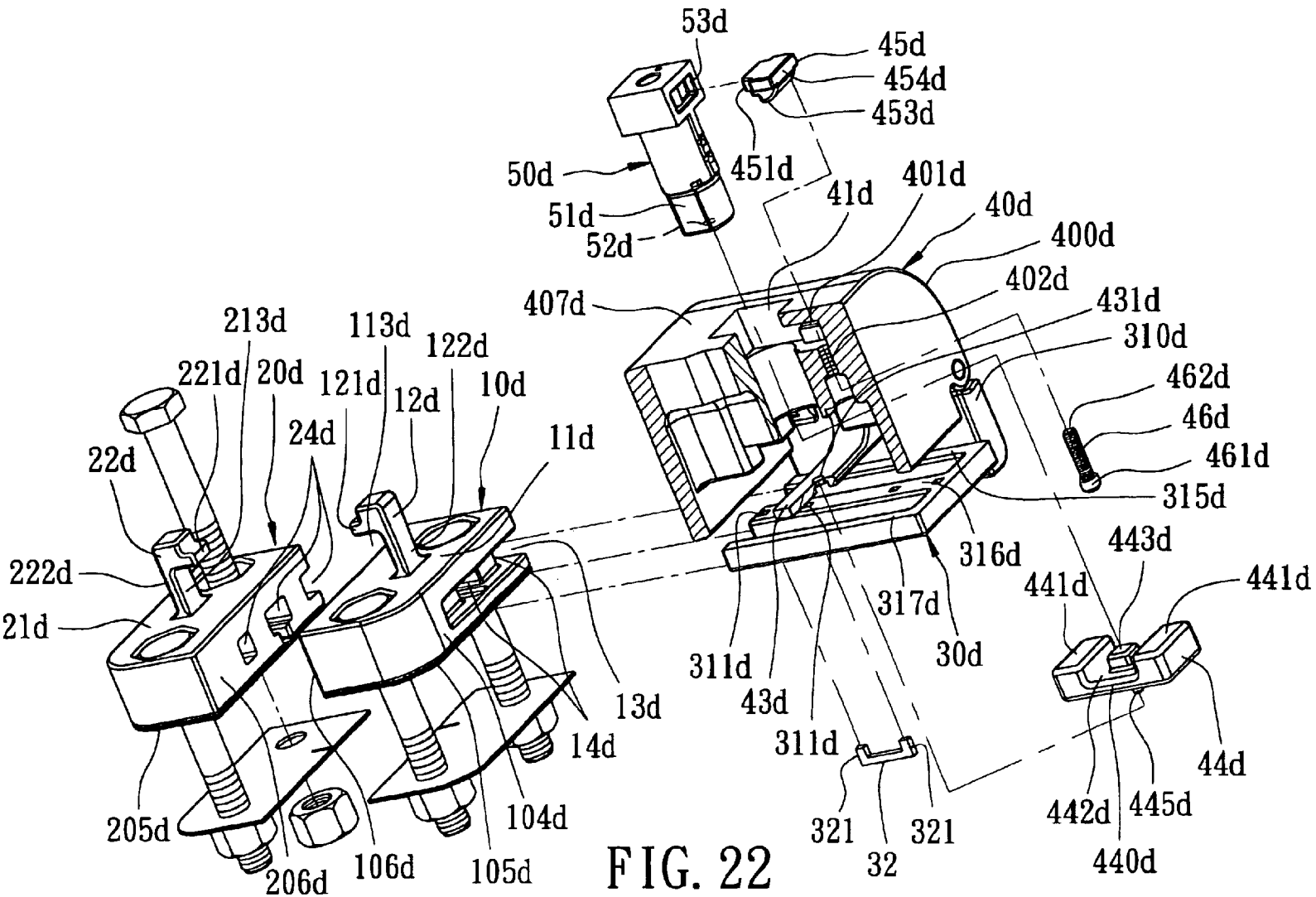
FIG. 22 is an exploded perspective view of a sixth preferred embodiment of the lock assembly according to the present invention.
Figure 23:
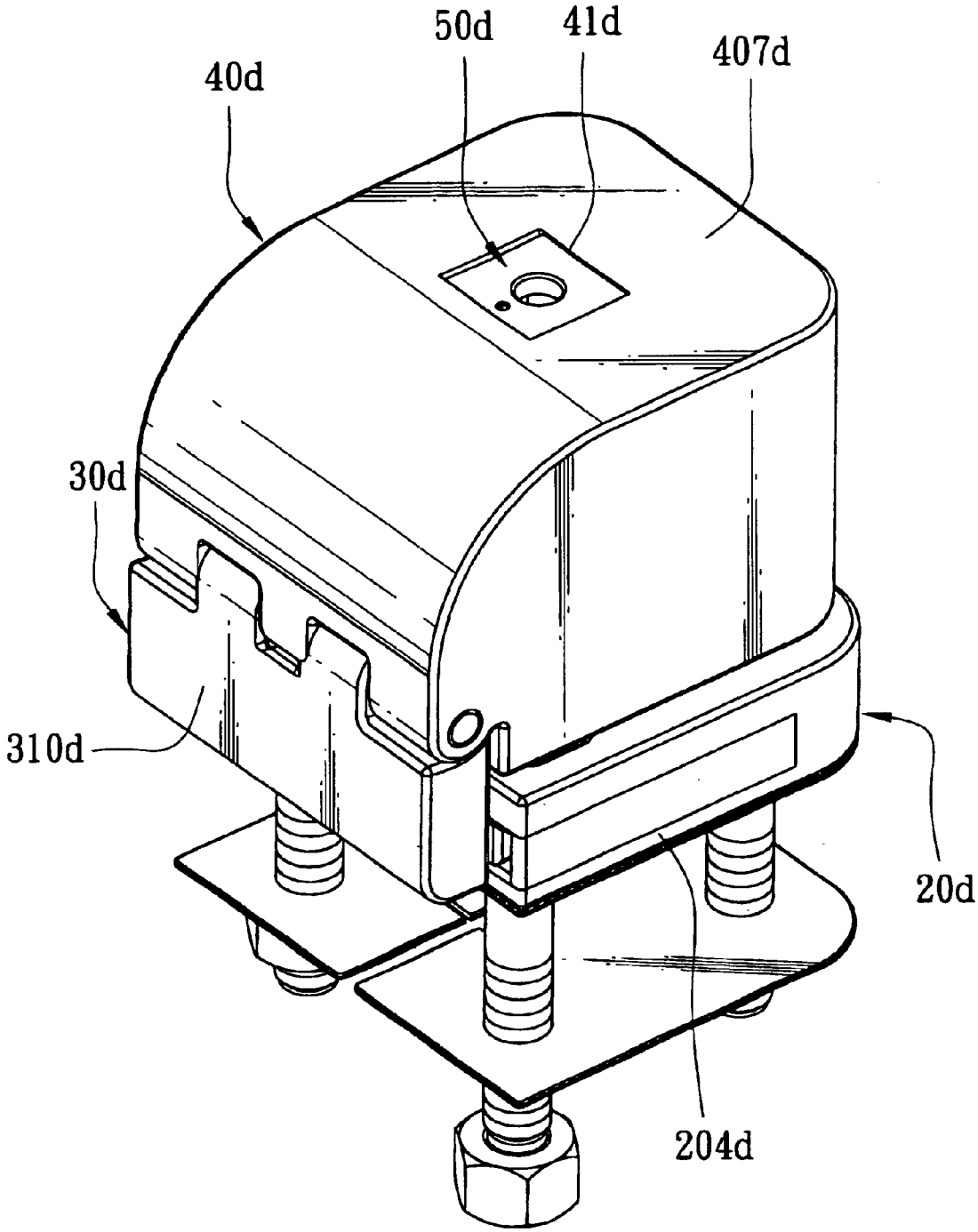
FIG. 23 is a perspective view of the sixth preferred embodiment.
Figure 24:
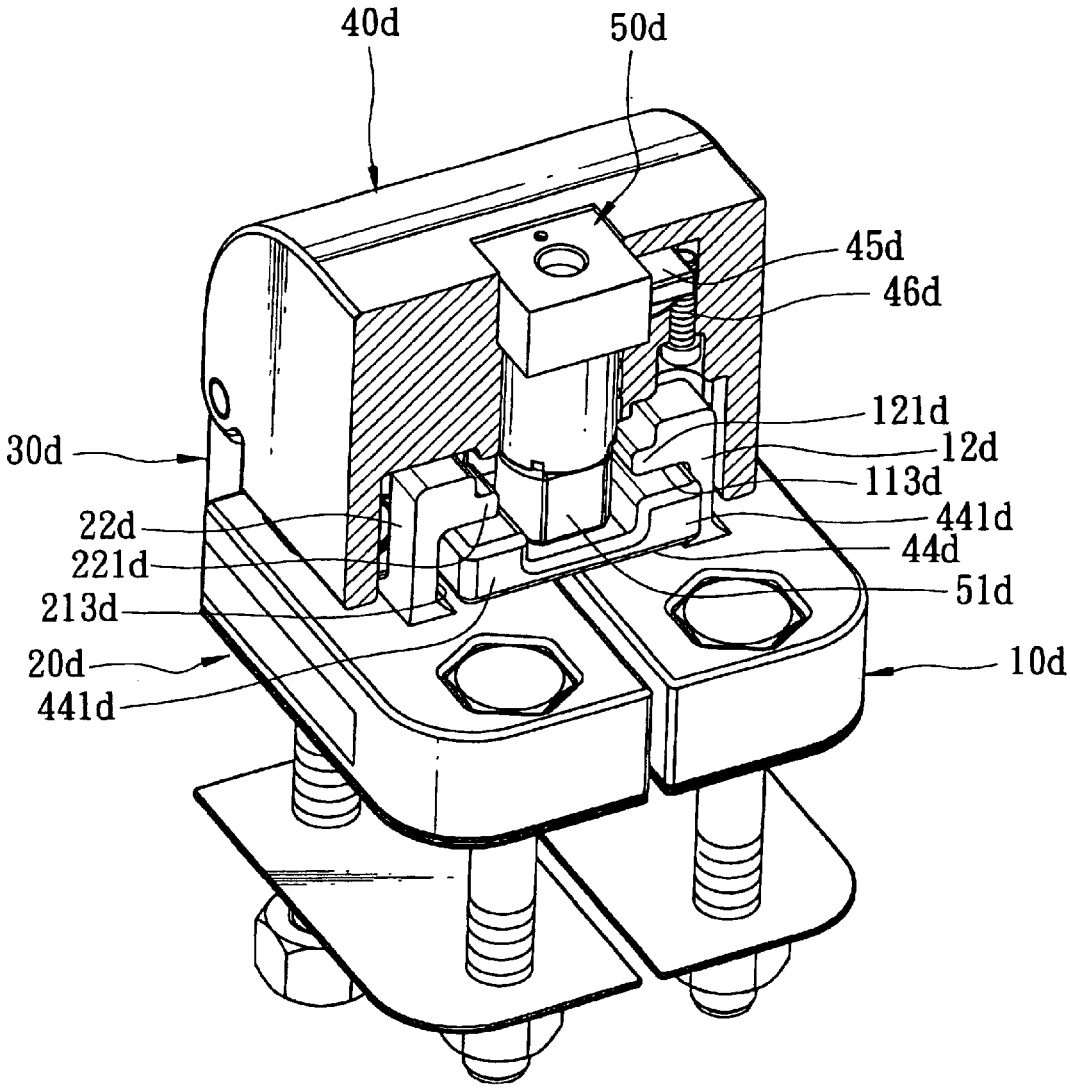
FIG. 24 is a partly cut-away perspective view of the sixth preferred embodiment, where a lock device is shown to be in a locking state.
Figure 25:
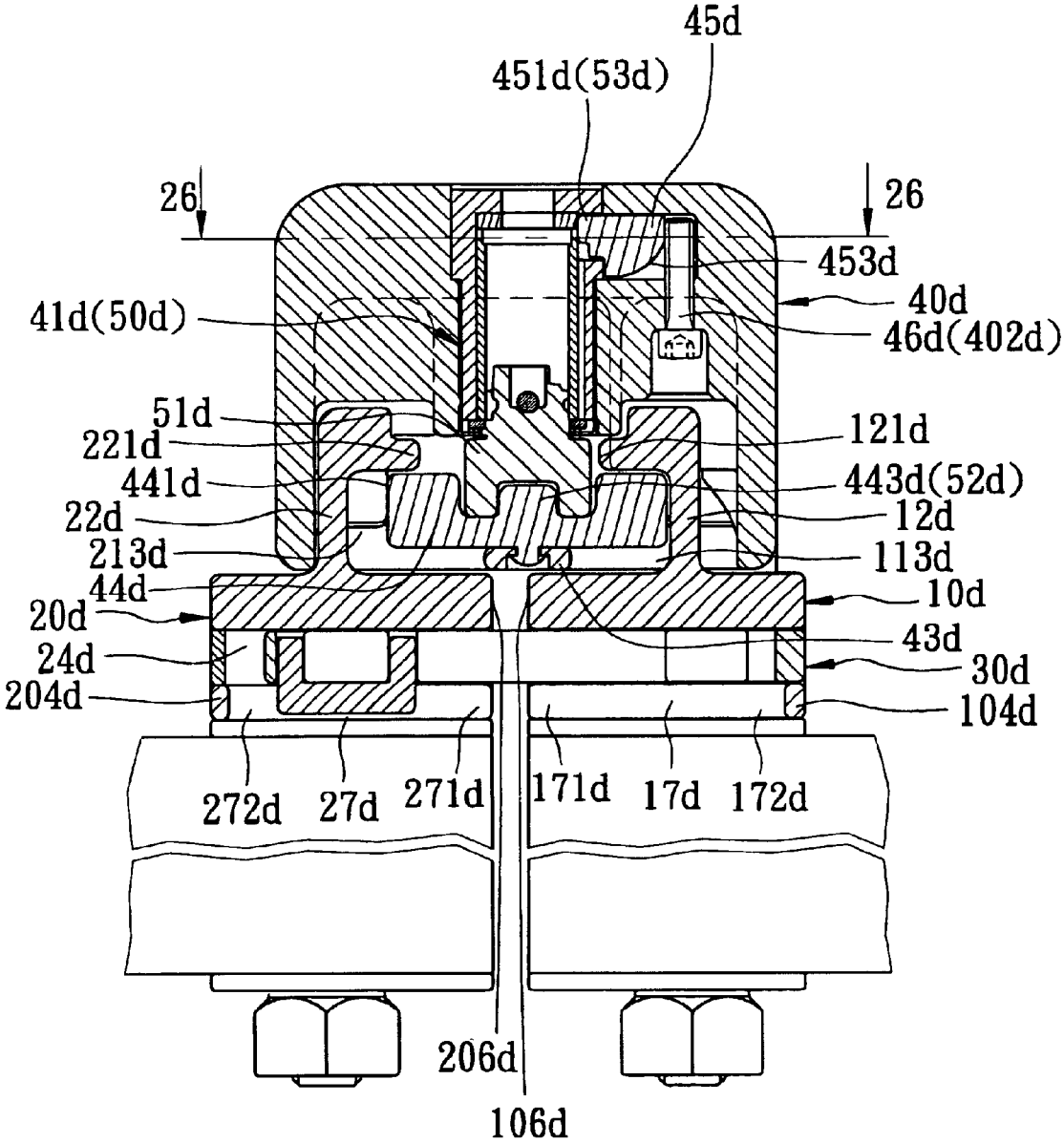
FIG. 25 is a cross-sectional view of FIG. 24, viewed from a bottom side of the lock assembly.

Referring to FIGS. 22 to 24, the sixth preferred embodiment of the lock assembly according to the present invention is shown to include a first mounting seat 10*d*, a second mounting seat 20*d*, a slide seat 30*d*, and a lock device 40*d*. Each of the first and second mounting seats 10*d*, 20*d* is adapted to be mounted on a respective one of two objects, such as two door panels, that are to be locked together. Each of the first and second mounting seats 10*d*, 20*d* has a rear side wall 105*d*, 205*d* adapted to face the corresponding door panel, a front side wall 11*d*, 21*d* opposite to the rear side wall 105*d*, 205*d*, an inner side wall 106*d*, 206*d* interconnecting inner edges of the front and rear side walls 11*d*, 21*d*, 105*d*, 205*d*, and an outer side wall 104*d*, 204*d* interconnecting outer edges of the front and rear side walls 11*d*, 21*d*, 105*d*, 205*d*. The mounting seats 10*d*, 20*d* are disposed on the door panels such that the inner side walls 106*d*, 206*d* are disposed proximate to and confront each other. The front side wall 11*d* of the first mounting seat 10*d* is formed with an L-shaped first shackle bar 12*d* which has a first section 122*d* connected to the front side wall 11*d* and perpendicular to the front side wall 11*d*, and a distal second section 121*d* extending transversely from the first section 122*d*. The first shackle bar 12*d* cooperates with the front side wall 11*d* to define a first latch groove 113*d* therebetween. The first mounting seat 10*d* is further formed with three first slide channels 14*d* which extend horizontally from the inner side wall 106*d* toward the outer side wall 104*d* and which are displaced from one another in a vertical direction. The front side wall 21*d* of the second mounting seat 20*d* is formed with an L-shaped second shackle bar 22*d* which has a first section 222*d* connected to the front side wall 21*d* and perpendicular to the front side wall 21*d*, and a distal second section 221*d* extending transversely from the first section 222*d* toward the first shackle bar 12*d*. The second shackle bar 22*d* cooperates with the front side wall 21*d* to define a second latch groove 213*d* therebetween. The second mounting seat 20*d* is further formed with three second slide channels 24*d* which extend horizontally from the inner side wall 206*d* toward the outer side wall 204*d* and which are displaced from one another in a vertical direction. The second slide channels 24*d* are aligned respectively with the first slide channels 14*d*. Each of the first and second slide channels 14*d*, 24*d* extends through the inner side wall 106*d*, 206*d* of the corresponding one of the first and second mounting seats 10*d*, 20*d*. The outer side wall 104*d* of the first mounting seat 10*d* is formed with an entrance 13*d* communicated with the first slide channels 14. The outer side wall 204*d* of the second mounting seat 20*d* defines a closed end of each of the second slide channels 24*d*. Referring to FIGS. 22 and 25, the rear side wall 105*d*, 205*d* of each of the first and second mounting seats 10*d*, 20*d* is formed with a limiting hole 17*d*, 27*d* that extends along and that is communicated with a middle one of the slide channels 14*d*, 24*d* in a corresponding one of the mounting seats 10*d*, 20*d*. The limiting holes 17*d*, 27*d* are aligned with each other. Each limiting hole 17*d*, 27*d* has a communicating end 171*d*, 271*d* formed through the inner side wall 106*d*, 206*d* of the corresponding mounting seat 10*d*, 20*d*, and an opposite limiting end 172*d*, 272*d* that is proximate to the outer side wall 104*d*, 204*d* of the corresponding mounting seat 10*d*, 20*d* and that is not formed through the outer side wall 104*d*, 204*d*.

The slide seat 30*d* has a horizontal top wall 310*d*, a connecting rod 319*d* extending downwardly from the top wall 310*d*, and three parallel sliding rods 315*d*, 316*d*, 317*d* which are disposed horizontally below the top wall 310*d* and which are spaced apart vertically from one another. Each of the sliding rods 315*d*, 316*d*, 317*d* has a connecting end portion connected to the connecting rod 319*d*, and a distal end portion distal from the connecting rod 319. During assembly, the sliding rods 315*d*, 316*d*, 317*d* are inserted into the first slide channels 14*d* through the entrance 13*d*. The distal end portion of a middle one of the sliding rods 316*d* is formed with an engaging hole unit which consists of a pair of engaging holes 311*d*. A stop member 32, which is formed as a U-shaped metal body, engages the engaging hole unit by extending two opposite ends 321 thereof into the pair of engaging holes 311*d* through one of the limiting holes 17*d*, 27*d* after the sliding rods 315*d*, 316*d*, 317*d* are inserted into the slide channels 14*d*. The stop member 32 thus projects from the middle one of the sliding rods 316*d*, and projects into one of the limiting holes 17*d*, 27*d*. The sliding rods 315*d*, 316*d*, 317*d* are slidable along the first and second slide channels 14*d*, 24*d*. The stop member 32 is movable with the middle one of the sliding rods 316*d* between the limiting ends 172*d*, 272*d* of the limiting holes 17*d*, 27*d*, thereby preventing removal of the slide seat 30*d* from the first mounting seat 10*d*, and thereby limiting sliding movement of the slide seat 30*d* between an engaging position and a disengaging position. In the engaging position, the sliding rods 315*d*, 316*d*, 317*d* extend into the first slide channels 14*d* and into the second slide channels 24*d* for engaging both the first and second mounting seats 10*d*, 20*d*, and the stop member 32 is disposed adjacent to the limiting end 272*d* of the limiting hole 27*d* in the second mounting seat 20, as shown in FIG. 25. In the disengaging position, the sliding rods 315*d*, 316*d*, 317*d* extend only into the first slide channels 14*d* and are removed from the second slide channels 24*d* for disengaging from the second mounting seat 20*d*, and the stop member 32 is disposed proximate to the limiting end 172*d* of the limiting hole 17*d* in the first mounting seat 10*d*.

The lock device 40*d* includes a lock casing 400*d* mounted pivotally on one end of the top wall 310*d* of the slide seat 30*d* so as to be turnable upwardly to an open position and downwardly to a closed position. The lock casing 400*d* has a convex front sidewall 407*d* formed with a lock core mounting hole 41*d* which has a key-operable lock core 50*d* mounted therein. The lock core 50*d* has one end provided with a latch engaging member 51*d* which is formed with a rectangular coupling hole 52*d*. The lock core 50*d* is operable by its corresponding key to rotate the latch engaging member 51*d* about an axis of the lock core 50*d*. A latch member 44*d* is mounted rotatably inside the lock casing 400*d*. The latch member 44*d* has two opposite locking end portions 441*d* and an intermediate portion 440*d* which interconnects the locking end portions 441*d* and which is thinner relative to the locking end portions 441*d* so as to define a recess 442*d* between the locking end portions 441*d* for receiving the latch engaging member 51*d* of the lock core 50*d*. The intermediate portion 440*d* is formed with a rectangular coupling protrusion 443*d* which extends into and which is coupled with the coupling hole 52*d* in the latch engaging member 51*d* such that the latch member 44*d* is co-rotatable with the latch engaging member 51*d* for moving between locking and unlocking positions when the lock core 50*d* is operated by its corresponding key. The lock casing 400*d* has a mounting beam 43*d* formed with a mounting hole 431*d* that is co-axial with the lock core 50*d*. The intermediate portion 440*d* of the latch member 44*d* is further formed with a cylindrical mounting stud 445*d* on one side opposite to the coupling protrusion 443*d*. The mounting stud 445*d* extends rotatably into the mounting hole 431*d* for mounting the latch member 44*d* rotatably in the lock casing 400*d*.

Referring to FIGS. 24 and 25, when the latch member 44*d* is in the locking position while the slide seat 30*d* is moved to the engaging position, the locking end portions 441*d* of the latch member 44*d* extend into the first and second latch grooves 113*d*, 213*d* and engage the second sections 121*d*, 221*d* of the first and second shackle members 12*d*, 22*d*, respectively, to prevent the lock casing 400*d* from turning upwardly to the open position. The lock device 40*d* thus engages the first and second shackle members 12*d*, 22*d* under this state for locking together the first and second mounting seats 10*d*, 20*d*.

Figure 27:
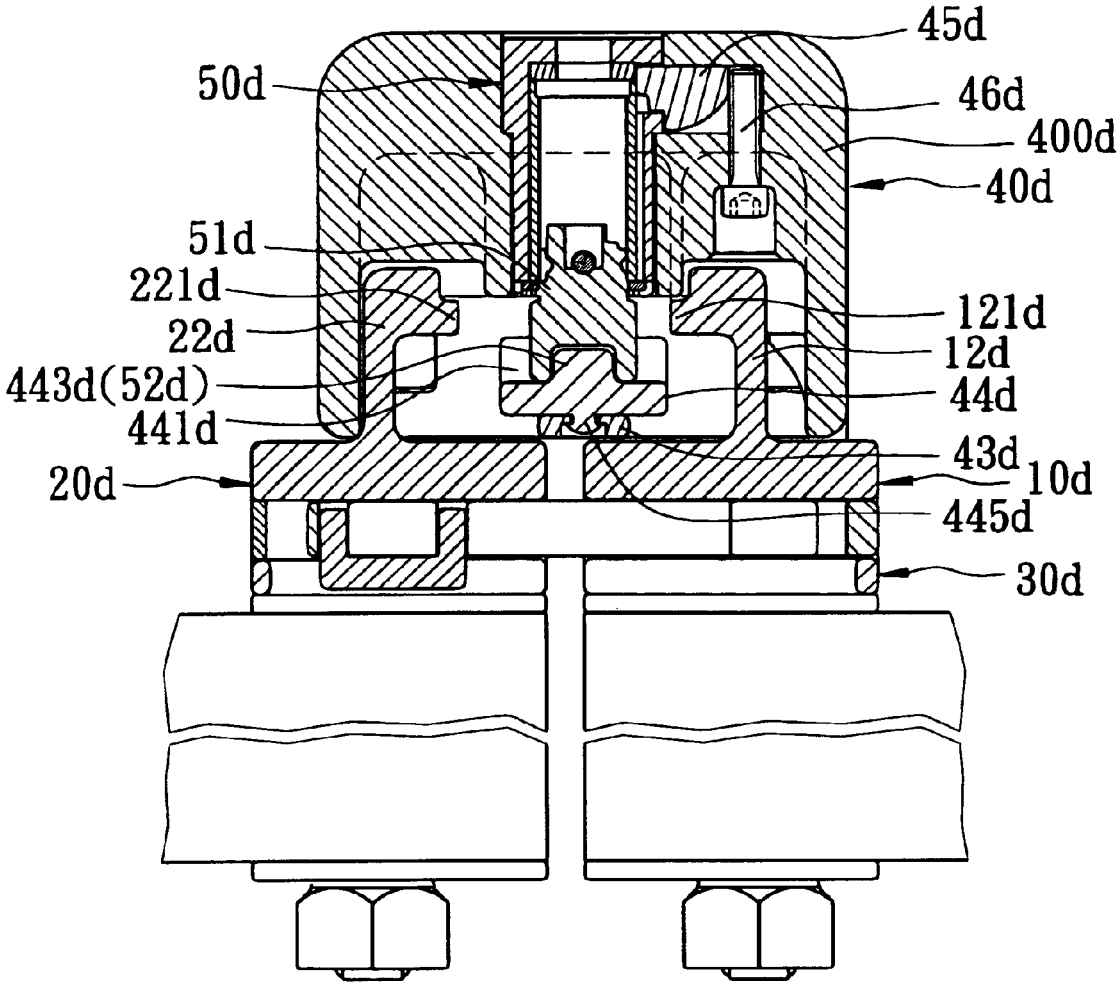
FIG. 27 is a cross-sectional view of the sixth preferred embodiment, viewed from a bottom side, where the lock device is shown to be in an unlocking state.

Referring to FIG. 27, when the latch member 44*d* is moved to the unlocking position while the slide seat 30*d* is in the engaging position, the locking end portions 444*d* of the latch member 44*d* are moved respectively and outwardly of the first and second latch grooves 113*d*, 213*d*, and are disengaged from the second sections 121*d*, 221*d* of the first and second shackle members 12*d*, 22*d* to permit upward turning of the lock casing 400*d* to the open position. When the lock casing 400*d* is moved to the open position, the slide seat 30*d* is movable from the engaging position to the disengaging position to permit relative movement of one of the first and second mounting seats 10*d*, 20*d* with its corresponding door panel relative to the other one of the first and second mounting seats 10*d*, 20*d*.

Figure 26:
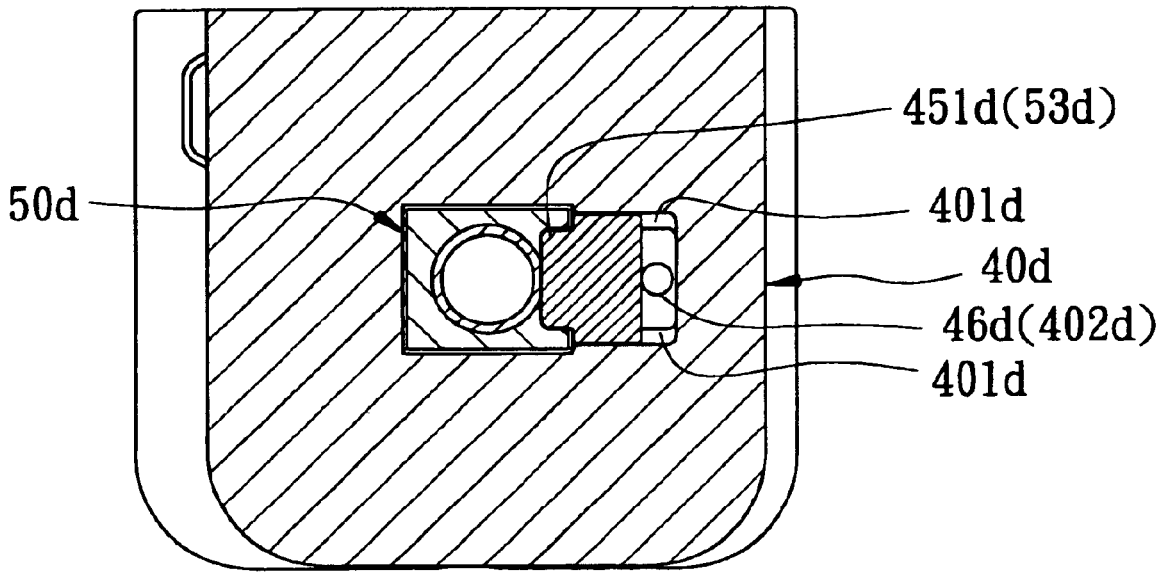
FIG. 26 is a cross-sectional view, taking along line 26—26 in FIG. 25.

Referring to FIGS. 22, 26 and 27, the lock device 40*d* is provided with a lock core retaining unit which includes a retaining block 45*d* and a threaded rod 46*d*. The lock core 50*d* has a shell formed with a retaining groove 53*d*. The retaining block 45*d* is mounted slidably in the lock casing 400*d*, and is slidable along a parallel pair of slide grooves 401*d* formed in the lock casing 400*d*. The slide grooves 401*d* are transverse to the axis of the lock core 50*d*. The retaining block 45*d* has a first end formed as a retaining protrusion 451*d*, a second end 454*d* opposite to the first end, and a convex side wall 453*d* extending from the second end 454*d* toward the first end. The threaded rod 46*d* is mounted threadedly in a threaded hole 402*d* formed in the lock casing 400*d*, and has a headed operating end 461*d* and a distal end 462*d* opposite to the operating end 461*d*. During assembly of the lock device 40*d*, the distal end 462*d* of the threaded rod 46*d* slides along the convex sidewall 463*d* and finally abuts against the second end 454*d* of the retaining block 45*d* so as to guide sliding movement of the retaining block 45*d* along the slide grooves 401*d* to enable the retaining protrusion 451*d* to extend into and engage the retaining groove 53*d* of the lock core 50*e* for retaining the lock core 50*d* in the lock core mounting hole 41*d* in the lock casing 400*d*. The operating end 461*d* of the threaded rod 46*d* is accessible when the lock device 40*d* is unlocked and when the lock casing 400*d* is turned to the open position. At this time, the operating end 461*d* of the threaded rod 46*d* is operable for unthreading from the threaded hole 402*d* such that the distal end 462*d* of the threaded rod 46*d* ceases to abut against the second end 454*d* of the retaining block 45*d* to enable disengagement of the lock core 50*d* from the retaining block 45*d*, thereby permitting removal of the lock core 50*d* from the lock casing 400*d* for replacement purposes.

Figure 28:
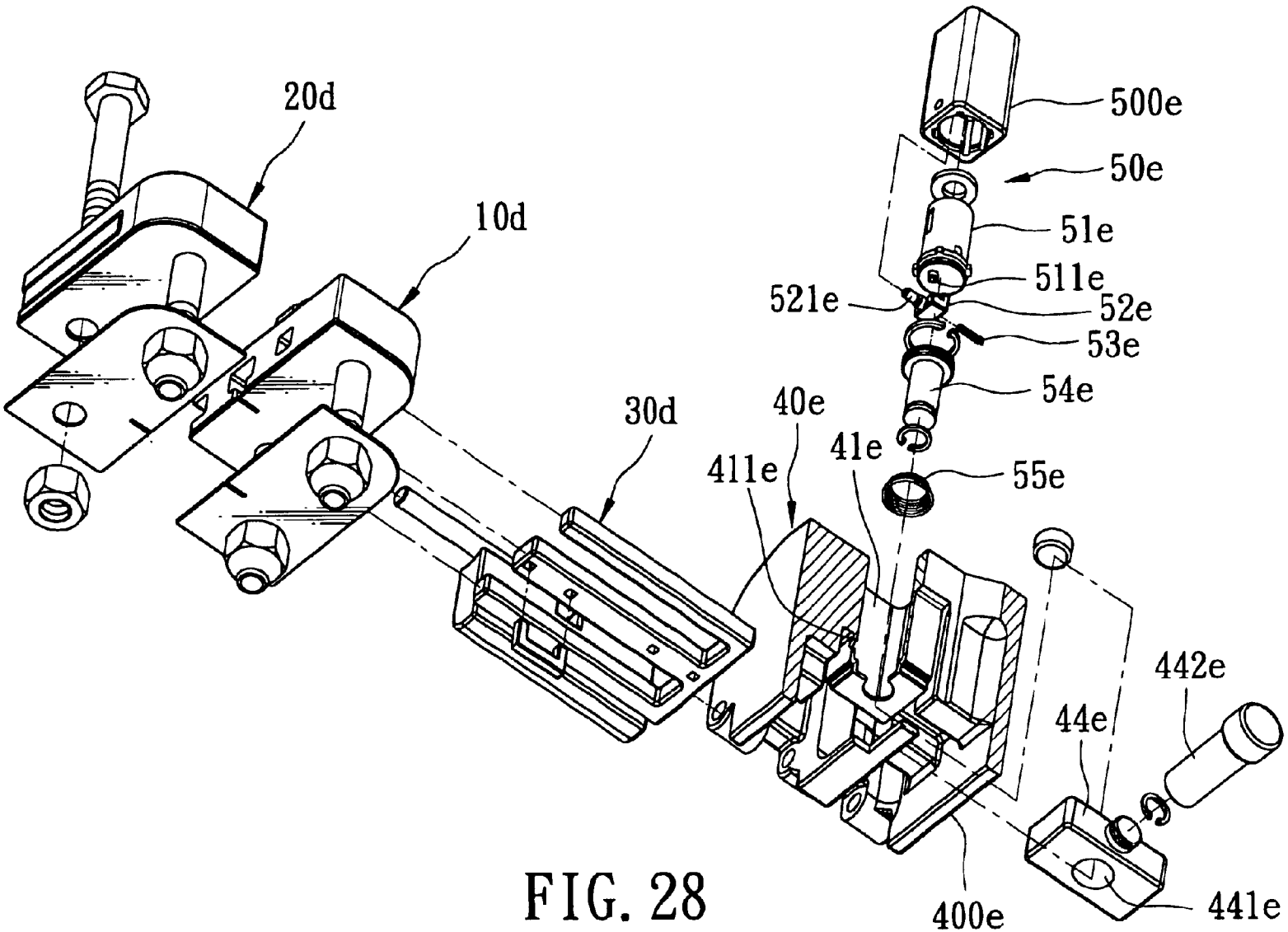
FIG. 28 is a partly cut-away exploded perspective view of a seventh preferred embodiment of the lock assembly according to the present invention.
Figure 29:
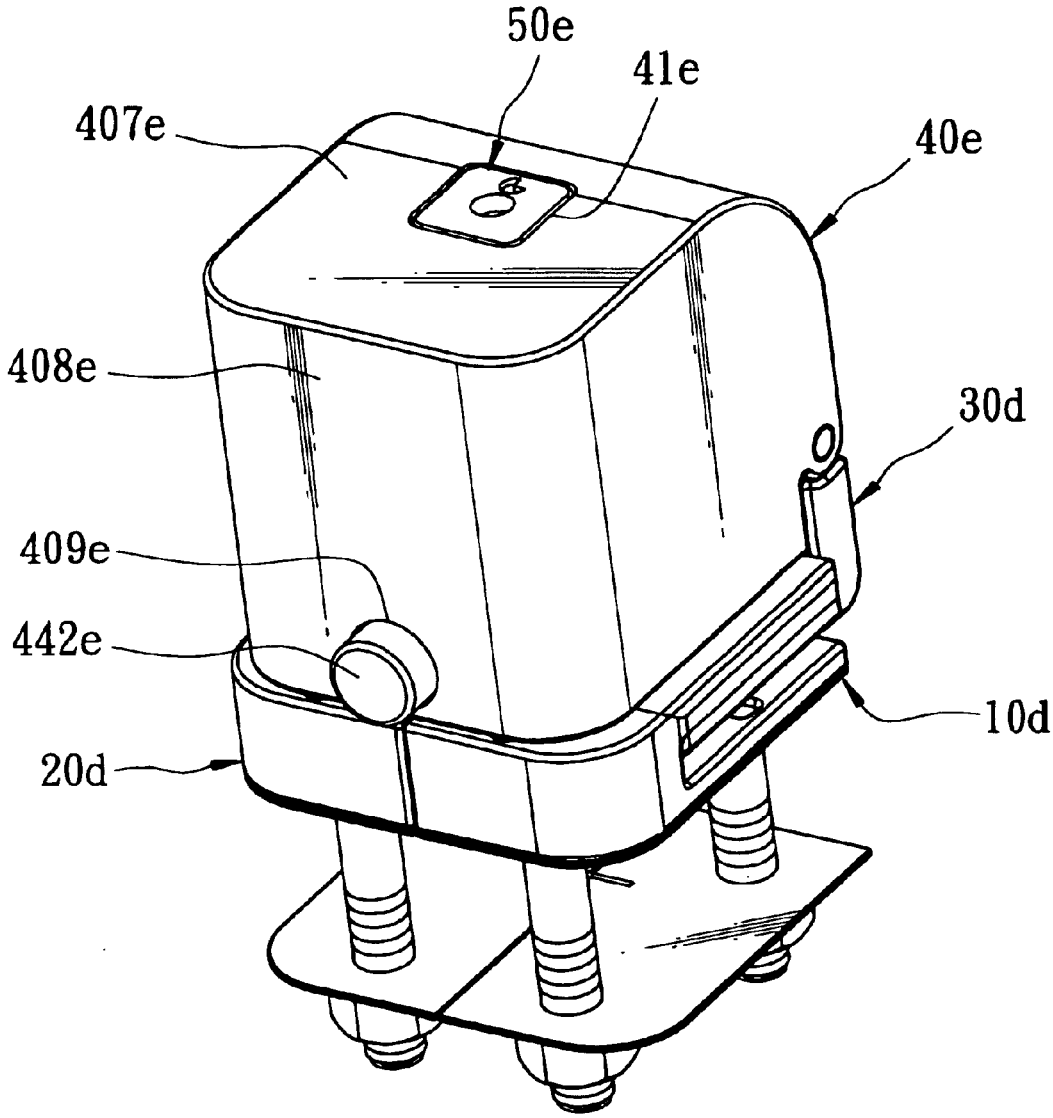
FIG. 29 is a perspective view of the seventh preferred embodiment, where a lock device is shown to be in a locking state.
Figure 30:
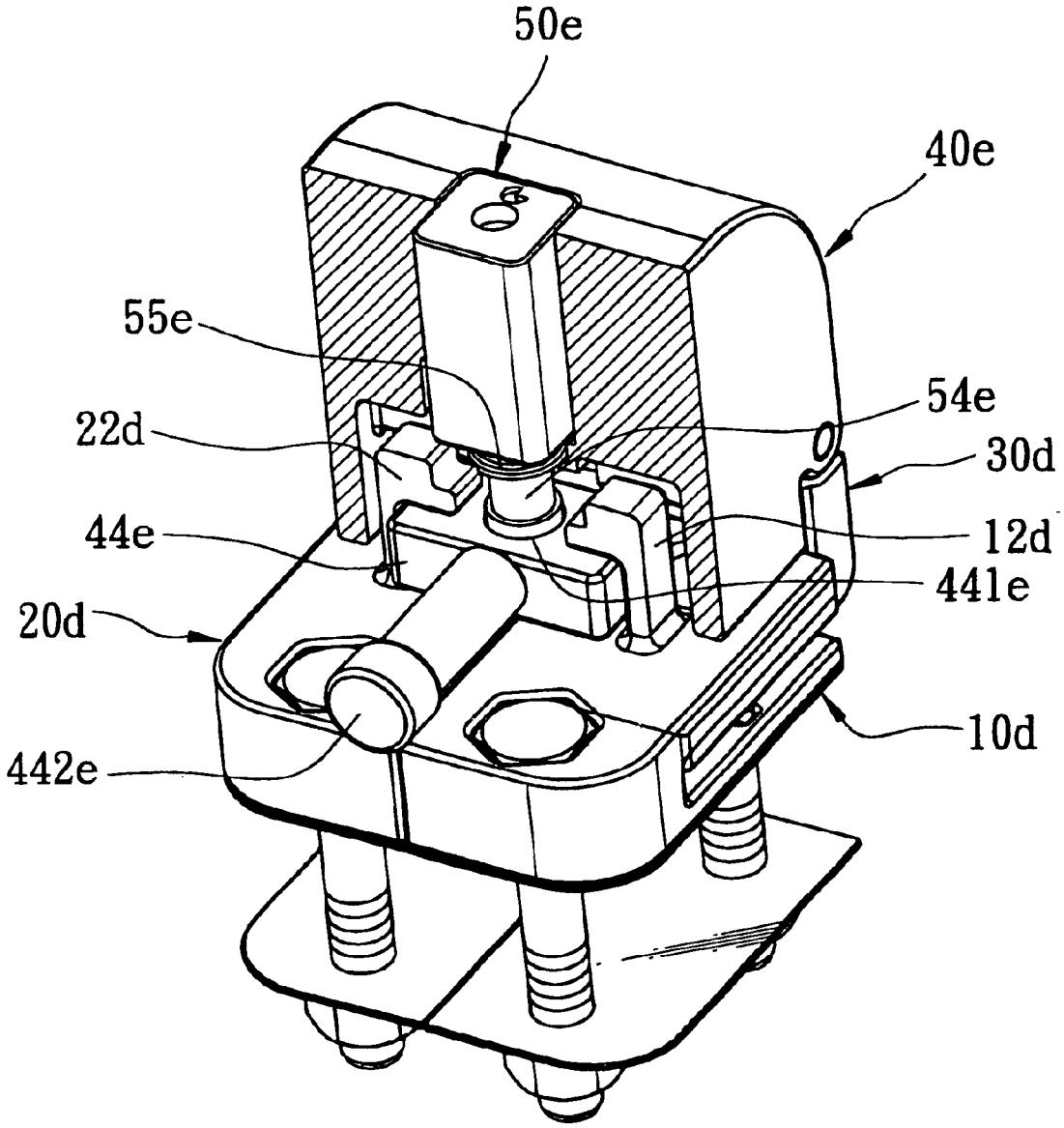
FIG. 30 is a partly-cutaway perspective view of the embodiment shown in FIG. 29.

Referring to FIGS. 28 to 30, a seventh preferred embodiment of the lock assembly according to the present invention is shown to include first and second mounting seats 10*d*, 20*d*, a slide seat 30*d*, and a lock device 40*e*. The first and second mounting seats 10*d*, 20*d* and the slide seat 30*d* have structures similar to those in the previous embodiment. The lock device 40*e* includes a lock casing 400*e* mounted pivotally on the slide seat 30*d* so as to be turnable upwardly to an open position and downwardly to a closed position, as with the previous embodiment. The lock casing 400*e* has a front side wall 407*e* which faces forwardly when the lock casing 400*e* is turned downwardly to the closed position and which is formed with a lock core mounting hole 41*e* that has a lock core 50*e* mounted therein, and a bottom side wall 408*e* which faces downwardly when the lock casing 400*e* is moved to the closed position and which is formed with a bottom opening 409*e*. The lock core 50*e* has a cylindrical lock core body 51*e* with an end wall that is formed with an eccentric drive pin 511*e* which is eccentric to an axis of the lock core body 51*e*. The lock core 50*e* further includes a retaining member 52*e* which is formed with a retaining pin 521*e* that extends radially with respect to the axis of the lock core body 51*e*. The retaining member 52*e* is biased by a spring 53*e* such that the retaining pin 521*e* projects radially from a shell 500*e* of the lock core 50*e* and engages a retaining hole 411*e* formed in the lock casing 400*e* and communicated with the lock core mounting hole 41*e* so as to retain the lock core 50*e* in the lock core mounting hole 41*e* of the lock casing 400*e*. The retaining member 52*e* engages the eccentric drive pin 511*e* of the lock core body 51*e* and is movable by the drive pin 511*e*, when the lock core 50*e* is operated by its corresponding key, for retracting into the shell 500*e* of the lock core 50*e*. The lock core 50*e* has a latch engaging rod 54*e* extending from the lock shell 500*e*, and a compression spring 55*e* which is sleeved on the latch engaging rod 54*e* and which applies a biasing force that pushes the lock core 50*e* to extend outwardly of the lock casing 400*e* through the lock core mounting hole 41*e*. The lock device 40*e* further includes a latch member 44*e* received in the lock casing 400*e*. The latch member 44*e* is formed with a central engaging hole 441*e* for engaging a distal end of the latch engaging rod 54*e*. The latch member 44*e* is connected fixedly to an operating rod 442*e* which extends through the bottom opening 409*e* in the lock casing 400*e* and which has a distal end disposed externally of the lock casing 400*e*. The operating rod 442*e* is disposed immediately below the latch member 44*e*, and extends downwardly from the latch member 44*e* when the lock casing 400*e* is moved to the closed position.

Figure 31:
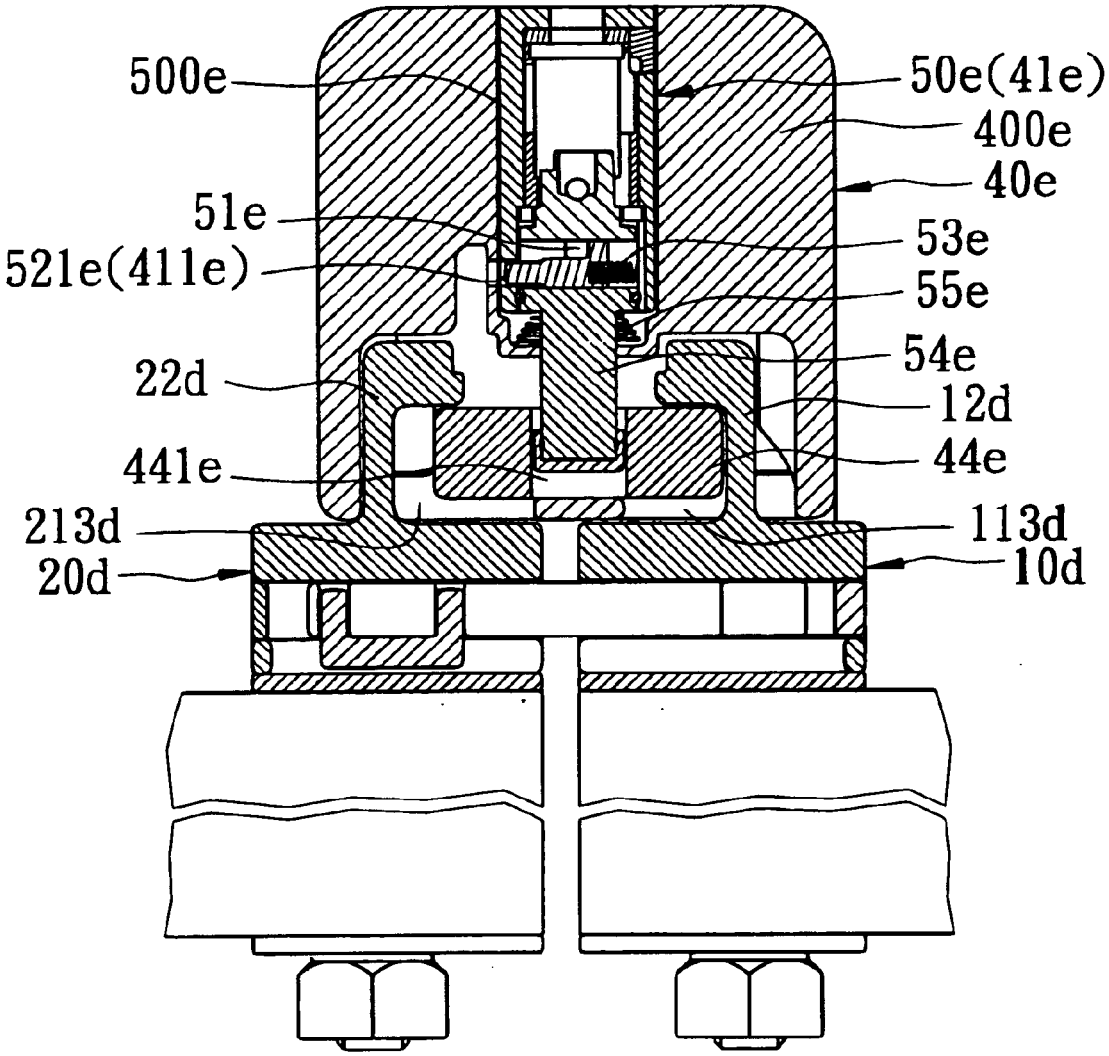
FIG. 31 is a cross-sectional view of FIG. 30, viewed from a bottom side of the lock assembly.

Referring to FIGS. 30 and 31, when the lock device 40*e* is in a locking state, the retaining pin 521*e* projects radially out of the lock shell 500*e* and engages the retaining hole 411*e* in the lock casing 400*e* to retain the lock core 50*e* in the lock core mounting hole 41*e* in the lock casing 400*e*. The distal end of the latch engaging rod 54*e* extends into the engaging hole 441*e* in the latch member 44*e*, and engages the latch member 44*e*. At this time, two opposite locking end portions of the latch member 44*e* extend respectively into the first and second latch grooves 113*d*, 213*d* and engage the first and second shackle members 12*d*, 22*d* for locking together the first and second mounting seats 10*d*, 20*d*.

Figure 32:
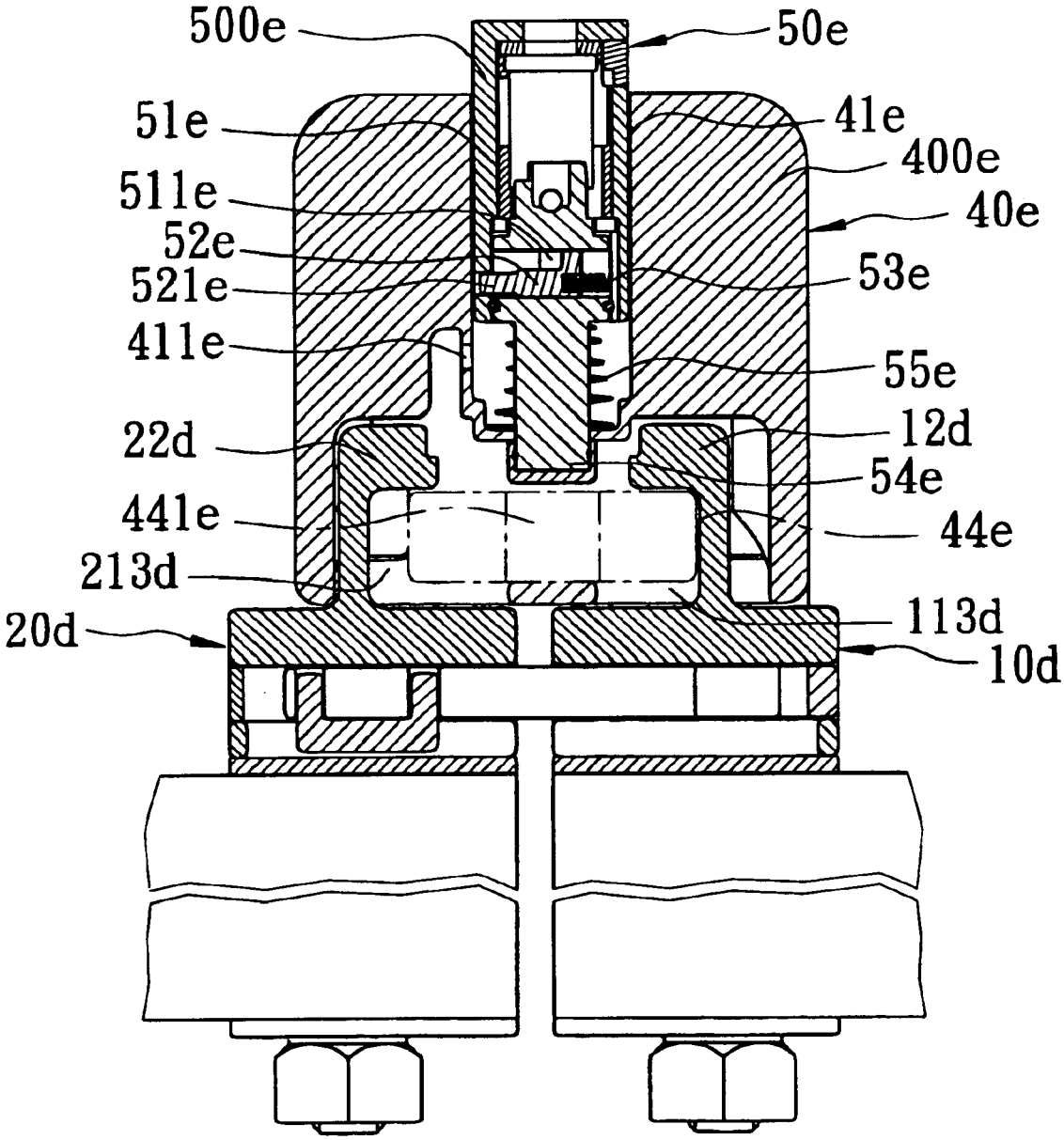
FIG. 32 is a cross-sectional view of the seventh preferred embodiment, where the lock device is shown to be in an unlocking state.
Figure 33:
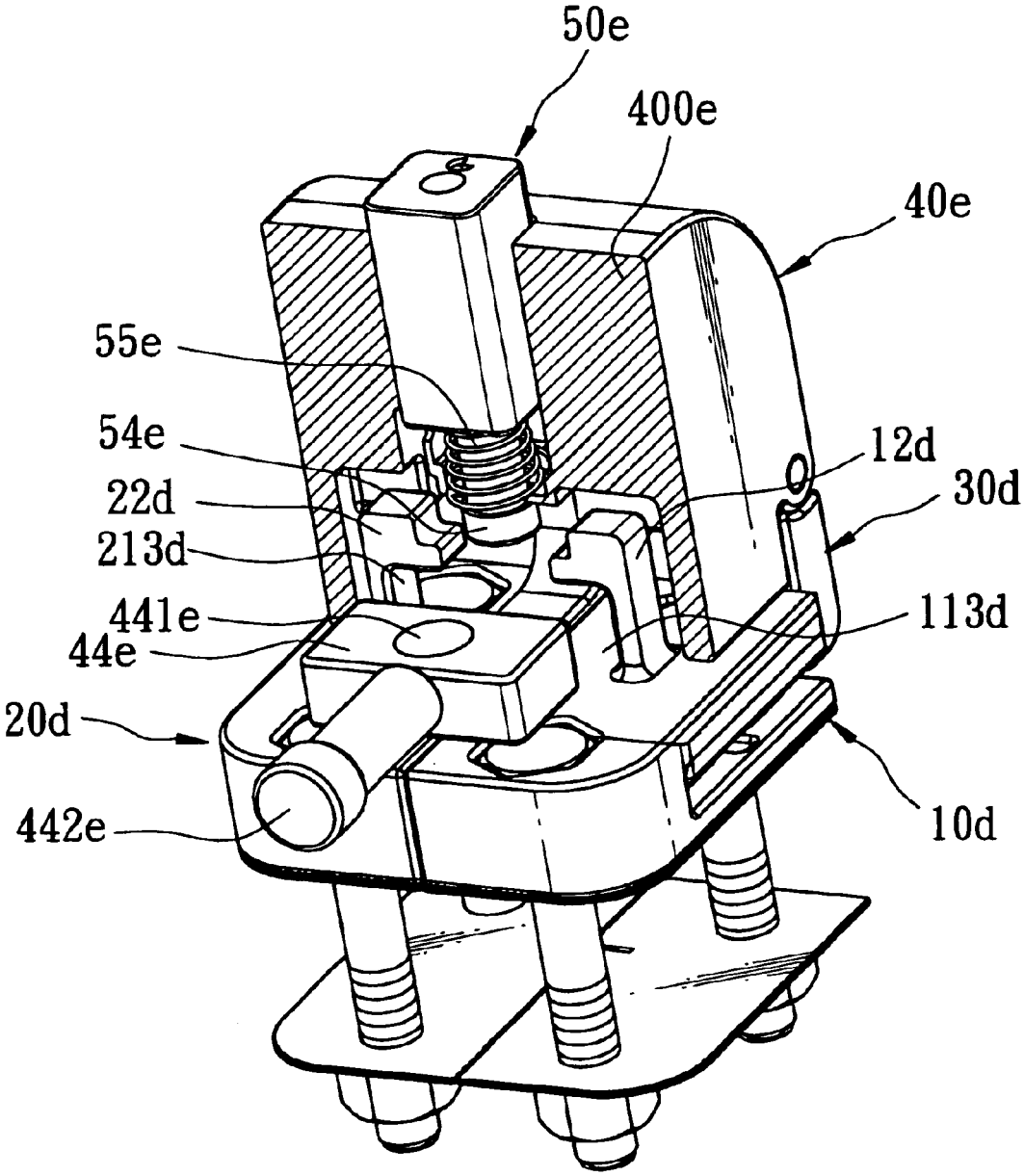
FIG. 33 is a partly cut-away perspective view of the seventh preferred embodiment, where the lock device is shown to be in the unlocking state.
Figure 34:
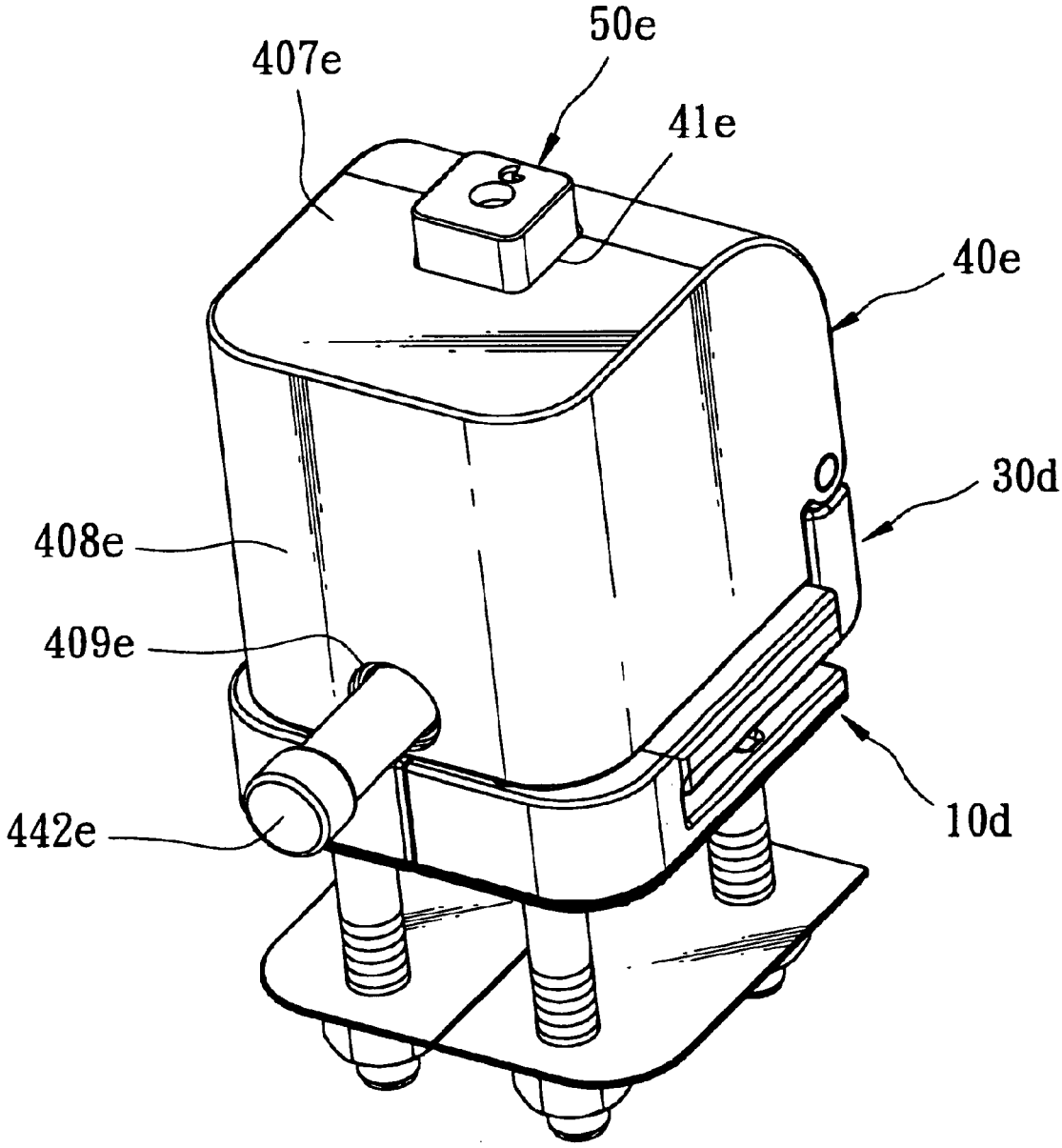
FIG. 34 is a perspective view of the seventh preferred embodiment, where the lock device is shown to be in the unlocking state.

Referring to FIGS. 32 to 34, when the lock core 50*e* is subsequently operated using its corresponding key, the lock core body 51*e* is rotated to enable the drive pin 511*e* to move the retaining member 52*e* so as to retract the retaining pin 521*e* into the lock shell 500*e*. At this time, the lock core 50*e* is pushed to extend outwardly of the lock casing 400*e* through the lock core mounting hole 41*e* due to the biasing action of the compression spring 55*e*. This results in corresponding movement of the latch engaging rod 54*e* such that the distal end of the latch engaging rod 54*e* is removed from the engaging hole 441*e* and is disengaged from the latch member 44*e*. At this time, the latch member 44*e* falls downwardly within the lock casing 400*e* by virtue of gravity, and is disengaged from the first and second shackle members 12*d*, 22*d* of the first and second mounting seats 10*d*, 20*d*, as best illustrated in FIG. 33. The lock device 40*e* is thus converted to an unlocking state, where the first and second shackle members 12*d*, 22*d* are disengaged from the lock device 40*e*, and the lock casing 400*e* is turnable upwardly to the open position. To lock the lock device 40*e* once again, the distal end of the operating rod 442*e* is pushed upwardly to move the latch member 44*e* toward the latch engaging rod 54*e* so as to once again extend the latch member 44*e* into the first and second latch grooves 113*d*, 213*d* after the slide seat 30 is moved to the engaging position and the lock casing 400*e* is turned downwardly to the closed position. Then, the lock core 50*e* is operated for retraction into the lock casing 400*e* so as to enable the distal end of the latch engaging rod 54*e* to engage the engaging hole 441*e* in the latch member 44*e*.

It has thus been shown that, when the lock device 40*e* is in the locking state, the shackle members 12*d*, 22*d* are entirely shielded and protected by the lock casing 400. An enhanced anti-theft effect is thus obtained.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A lock assembly comprising: a first mounting seat adapted to be mounted on a first object, said first mounting seat having a rear side wall adapted to face the first object, and a front side wall provided with a first lobe that is formed with a first shackle hole therethrough, said first mounting seat being further formed with a first slide channel;

a second mounting seat adapted to be mounted on a second object, said second mounting seat having a rear side wall adapted to face the second object, and a front side wall provided with a second lobe which is formed with a second shackle hole that is axially aligned with said first shackle hole, said second mounting seat being formed with a second slide channel which is aligned and communicated with said first slide channel;

a padlock including a lock body and a U-shaped shackle mounted on said lock body;

a slide seat having a sliding rod which is slidable along said first and second slide channels between an engaging position, in which said sliding rod extends into said first and second slide channels for engaging said first and second mounting seats, and a disengaging position, in which said sliding rod is disposed in said first slide channel and is removed from said second slide channel for disengaging from said second mounting seat so as to permit movement of one of said first and second mounting seats with the corresponding object relative to the other one of said first and second mounting seats; and a cover member mounted pivotally on said slide seat, said cover member confining an accommodating space and being formed with a third lobe that is disposed in said accommodating space, said third lobe being formed with a third shackle hole therethrough, said cover member being pivotable relative to said slide seat for moving between a closed position and an open position, said first and second lobes extending into said accommodating space so as to be covered by said cover member and so as to dispose said third lobe between said first and second lobes and to enable said third shackle hole to align axially with said first and second shackle holes in order to permit extension of said shackle of said padlock through said first, second, and third shackle holes such that said shackle is shielded by said cover member when said cover member is moved to said closed position while said slide seat is disposed in said engaging position, said third lobe being turned away from said first and second lobes to permit sliding movement of said slide seat between said engaging and disengaging positions when said cover member is moved to the open position after removal of said shackle from said first, second and third lobes.

2. The lock assembly as claimed in claim 1, wherein each of said first and second slide channels extends in a horizontal direction.

3. The lock assembly as claimed in claim 2, wherein said rear side wall of each of said first and second mounting seats is formed with an elongated limiting hole therethrough, said limiting hole extending along and being communicated with said slide channel in a corresponding one of said first and second mounting seats, said limiting hole in said first mounting seat being aligned with said limiting hole in said second mounting seat, each of said first and second mounting seats having an inner side wall proximate to the other one of said first and second mounting seats, and an outer side wall opposite to said inner side wall, said limiting hole in each of said first and second mounting seats having a communicating end formed through said inner side wall in the corresponding one of said first and second mounting seats, and a limiting end opposite to said communicating end, said limiting end being disposed proximate to said outer side wall of the corresponding one of said first and second mounting seats, said sliding rod being provided with a stop member which projects into said limiting hole in one of said first and second mounting seats and which is movable along said limiting holes in said first and second mounting seats between said limiting ends of said limiting holes for limiting movement of said slide seat between said engaging and disengaging positions.

4. The lock assembly as claimed in claim 3, wherein said slide seat has a top wall formed with a first pivot portion for connecting pivotally with said cover member, and a connecting rod extending downwardly from said top wall, said sliding rod being disposed below said top wall and having a connecting end connected to said connecting rod, and a distal end which is distal from said connecting rod and which is formed with an engaging hole unit for engaging said stop member.

5. The lock assembly as claimed in claim 4, wherein said stop member is formed as a U-shaped body with two opposite ends, said engaging hole unit including a pair of engaging holes for engaging said opposite ends of said stop member.

6. The lock assembly as claimed in claim 4, wherein said cover member has an upper end formed with a second pivot portion which is mounted pivotally on said first pivot portion for pivoting about a horizontal axis, said cover member being turnable upwardly relative to said slide seat for moving to said open position, and being turnable downwardly relative to said slide seat for moving to said closed position, said accommodating space opening in downward and rearward directions when said cover member is moved to said closed position.

7. The lock assembly as claimed in claim 6, wherein said first pivot portion of said slide seat has a pair of inclined end walls facing said second pivot portion of said cover member, and a pair of first pivot tubes disposed between and projecting from said inclined end walls, each of said inclined end walls inclining downwardly and forwardly and having a concave surface, said second pivot portion having a pair of second pivot tubes that flank said first pivot tubes and that are disposed respectively adjacent to said concave surfaces of said inclined end walls, said first and second pivot tubes being formed with aligned pivot holes, said lock assembly further including a pivot axle extending through said pivot holes in said first and second tubes for connecting pivotally said first and second pivot portions.

8. The lock assembly as claimed in claim 1, wherein said cover member includes a front cover plate with an inner surface facing said accommodating space and two opposite edges, and a pair of side cover plates extending rearwardly from said opposite edges of said front cover plate and cooperating with said front cover plate to confine said accommodating space, said third lobe extending rearwardly from said inner surface of said front cover plate, each of said side cover plates being formed with a slot that has a size corresponding to a size of said shackle of said padlock and that permits extension of said shackle therethrough.

9. The lock assembly as claimed in claim 1, wherein each of said first and second lobes has an outer side surface opposite to the other one of said first and second lobes, and a lower edge, said outer side surface being formed with an indented shackle recess that extends downwardly from said shackle hole in the corresponding one of said first and second lobes to said lower edge of the corresponding one of said first and second lobes, said shackle being partially received in said shackle recesses of said first and second lobes when said shackle is extended through said first, second, and third lobes while said padlock is locked.

10. The lock assembly as claimed in claim 1, wherein each of said first and second lobes has an outer side surface opposite to the other one of said first and second lobes, and an inner side surface confronting the other one of said first and second lobes, said front side wall of one of said first and second mounting seals being formed with a positioning groove adjacent to said inner side surface of a corresponding one of said first and second lobes, said third lobe extending into said positioning groove when said slide seat is disposed in the engaging position while said cover member is moved to the closed position.

* * * * *